US006256952B1

(12) United States Patent
Fahy, Jr. et al.

(10) Patent No.: US 6,256,952 B1
(45) Date of Patent: Jul. 10, 2001

(54) PERFORATED RAISED FLOORING PANEL

(75) Inventors: James H. Fahy, Jr., Exton, PA (US); Joseph Hocevar, Caledonia; Robert Davison, Holland, both of MI (US)

(73) Assignee: Interface, Inc., Atlanta, GA (US)

( * ) Notice: Subject to any disclaimer, the term of this patent is extended or adjusted under 35 U.S.C. 154(b) by 0 days.

(21) Appl. No.: 09/284,597

(22) PCT Filed: Jul. 27, 1998

(86) PCT No.: PCT/US98/15901

§ 371 Date: Apr. 16, 1999

§ 102(e) Date: Apr. 16, 1999

(87) PCT Pub. No.: WO99/05372

PCT Pub. Date: Feb. 4, 1999

(51) Int. Cl.[7] ..... E04B 5/43

(52) U.S. Cl. ..... 52/263; 52/126.6; 52/630; 52/799.1

(58) Field of Search ..... 52/263, 127.6, 52/127.7, 127.8, 585.1, 630, 799.1, 126.6, 648.1, 126.7, 650.3, 655.1, 656.1

(56) References Cited

U.S. PATENT DOCUMENTS

| | | |
|---|---|---|
| Re. 33,220 | 5/1990 | Collier . |
| 3,924,370 | 12/1975 | Cauceglia et al. . |
| 4,085,557 | 4/1978 | Tharp . |
| 4,319,520 | 3/1982 | Lanting et al. . |
| 4,663,909 | 5/1987 | Ogino et al. . |
| 4,685,258 | 8/1987 | Av-Zuk . |
| 4,745,715 | 5/1988 | Hardwicke et al. . |
| 4,824,498 | 4/1989 | Goodwin et al. . |
| 4,874,127 | 10/1989 | Collier . |
| 4,901,004 | 2/1990 | King . |
| 4,901,490 | 2/1990 | Zinniel et al. . |
| 4,982,539 | 1/1991 | Hiller . |
| 5,090,169 | 2/1992 | Takeda et al. . |
| 5,184,438 | 2/1993 | Takeda et al. . |
| 5,187,907 | 2/1993 | Takeda et al. . |
| 5,197,244 | 3/1993 | Takeda et al. . |
| 5,245,805 | 9/1993 | Takeda et al. . |
| 5,467,609 | 11/1995 | Feeney . |
| 5,537,794 | 7/1996 | Tolliver et al. . |
| 5,603,134 | 2/1997 | Whipkey et al. ..... 14/2.4 |

FOREIGN PATENT DOCUMENTS

| | | |
|---|---|---|
| 38 01 765 A1 | 7/1989 | (DE) . |
| 1425977 | 2/1976 | (GB) . |

*Primary Examiner*—Christopher T. Kent
*Assistant Examiner*—Jennifer I. Thissell
(74) *Attorney, Agent, or Firm*—Kristin L. Johnson, Esq.; John S. Pratt, Esq.; Kilpatrick Stockton LLP

(57) ABSTRACT

Flooring systems including a metal raised access flooring panel (10) that is solid or is perforated by oval or oblong openings having major axes not parallel to any panel edge. The major slot axes may, for instance, be at a 45° angle to each panel edge. The slots (28) may be arranged in "clusters" of six slots, with one pair of slots above another pair and one slot to each side of, and mid-way above and below, the stacked pairs. Alternatively, the panels (10) may be perforated by circular holes arranged in a similar pattern. Adjacent panels may be interlocked with retractable pins extending from one panel (10) to another. Pedestal heads and stringers are adapted to accommodate panels of different sizes.

26 Claims, 22 Drawing Sheets

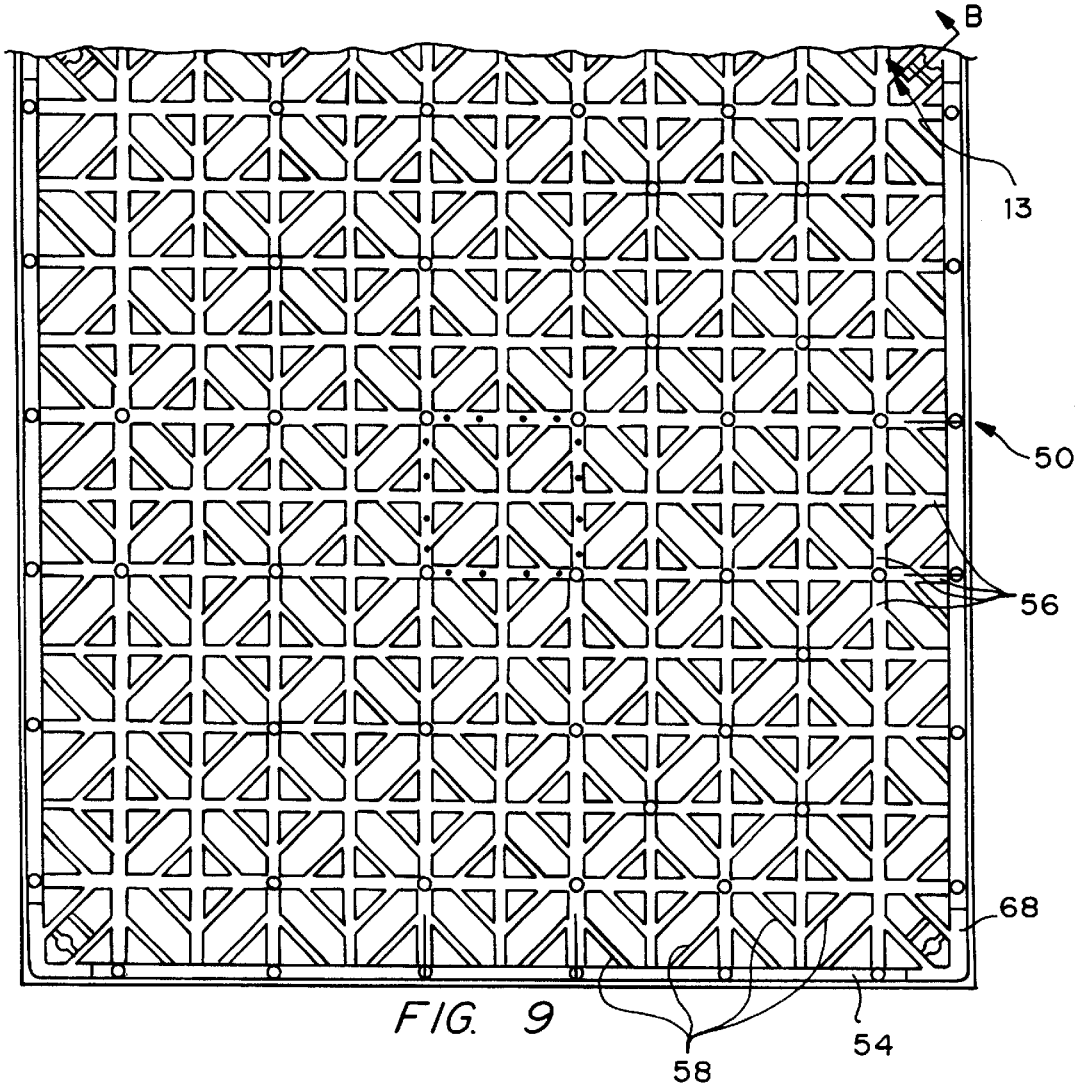
FIG. 9
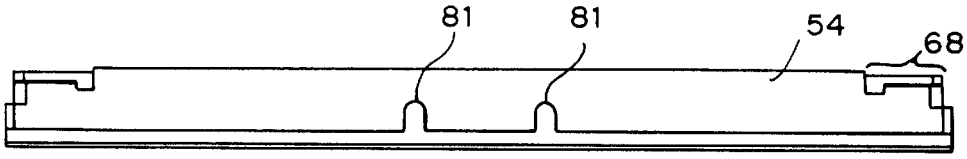
FIG. 9A
FIG. 9B
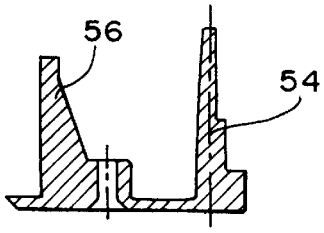
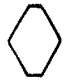
FIG. 9C

FIG. 10
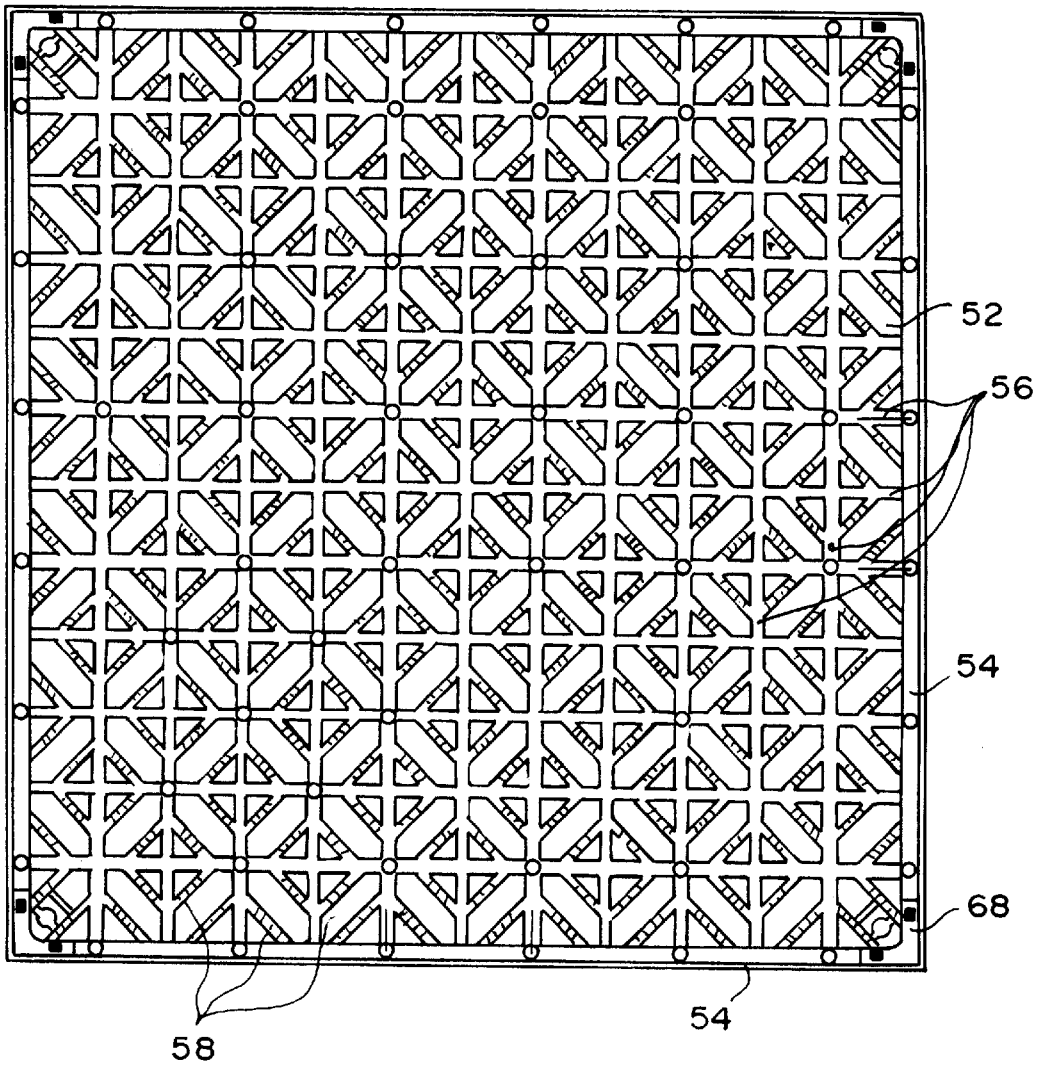
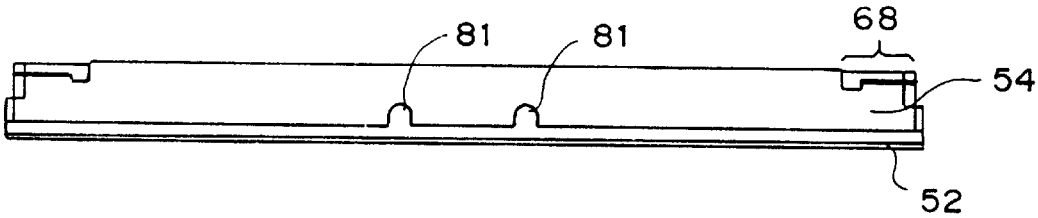
FIG. 10B

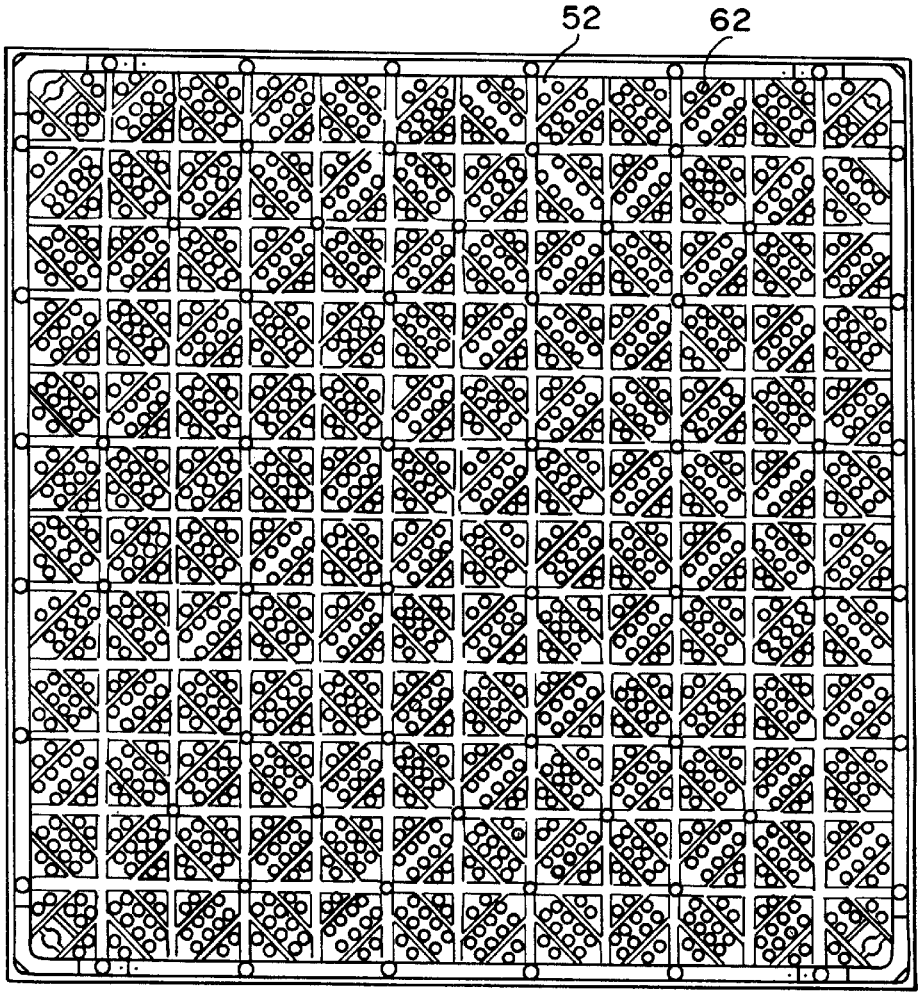
FIG. 12
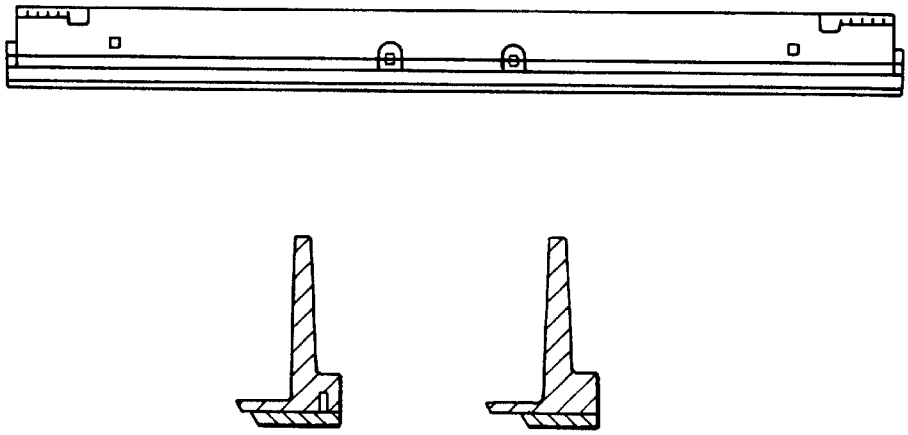

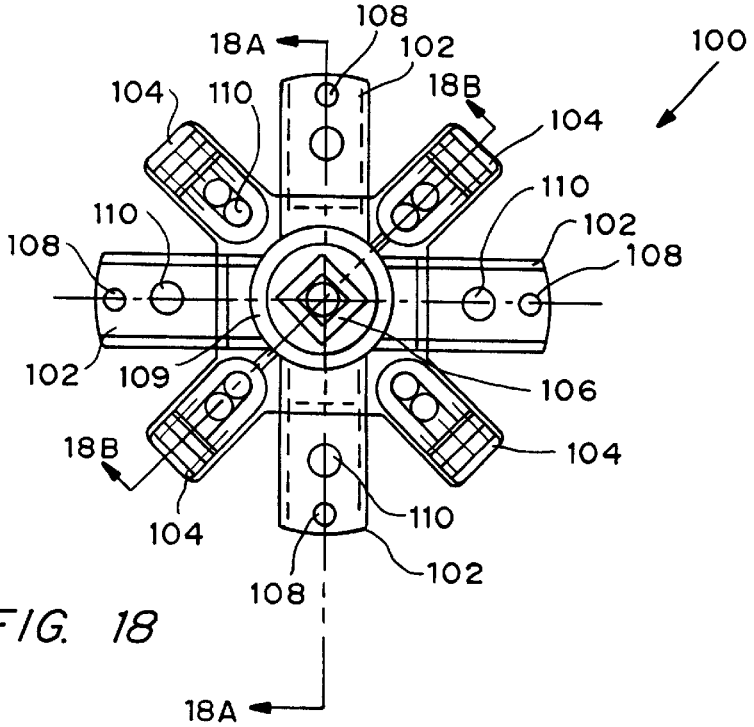
FIG. 18
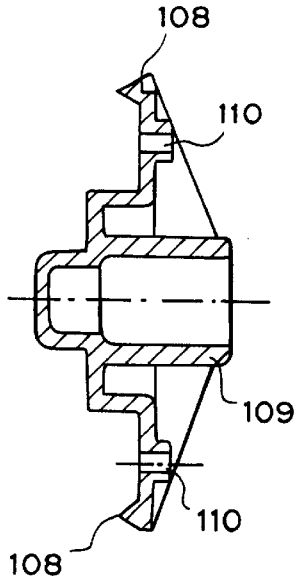
FIG. 18A
FIG. 18C
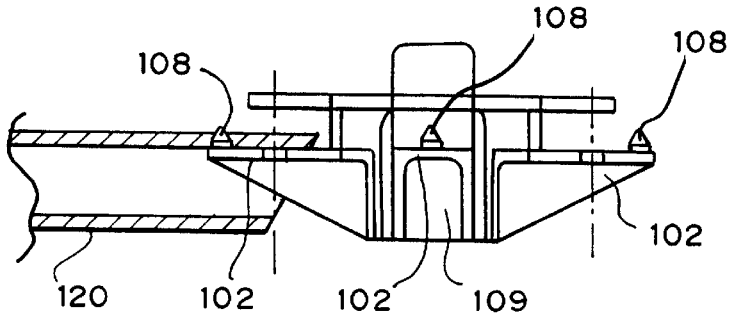
FIG. 18D
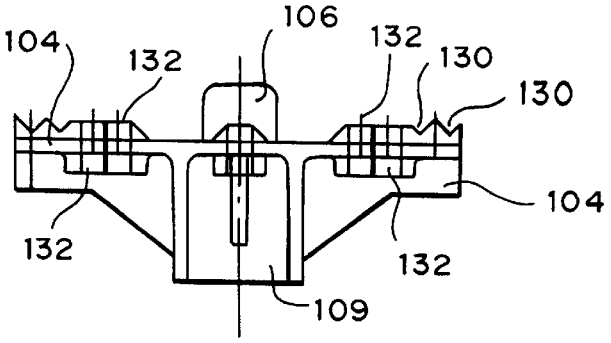

PERFORATED RAISED FLOORING PANEL

FIELD OF THE INVENTION

This invention relates to raised panel flooring, particularly including such flooring used in clean room environments.

BACKGROUND OF THE INVENTION

Raised panel flooring, also known as access flooring, is used in a variety of situations, including ones where it is desirable or convenient to run cabling in a space under such flooring and ready access to the cables is desirable. The flooring panels may be supported by a pedestal and stringer structure such as that shown in U.S. Pat. No. 4,685,258, entitled "Access flooring with Increased Load Capacity," dated Aug. 11, 1987, which is incorporated herein by this reference. Other types and configurations of support structures will be apparent to one skilled in the art.

It is desirable for some of such panels to be perforated to permit airflow between the subfloor and the room. However, many conventional perforation patterns, such as the pattern illustrated in U.S. Design Pat. No. Des. 350,613, can present a problem when the traffic across them includes wheeled carts. Such patterns cause caster wheels and other wheels to chatter or bump up and down. This chattering or bouncing may jostle the carts. Ordinarily, such jostling is not harmful; however, in some situations the items held in the carts are extremely sensitive, such as silicon wafers used in the production of semiconductors. Even very slight jostling can damage these sensitive materials.

In addition to chatter caused by perforations, any misalignments between adjacent panels also may jostle the cart. For instance, any difference in height between adjacent panels can create a lip or step which will cause a jolt as a wheel passes from panel to panel. Likewise, gaps between panels also may induce undesirable jostling of the cart. Moreover, any deflection in a panel under load may cause the floor surface to be uneven, thereby inducing unwanted vibration or movement in carts being moved over the floor.

Furthermore, panels often are provided in different sizes. For example, panels may be dimensioned in English or Metric units. Consequently, the hardware associated with different sized panels generally corresponds to the selected size. Thus, manufacturers must make and users must stock two different sets of components, such as pedestal heads and stringers, substantially increasing handling costs.

A conventional pedestal head typically has bosses positioned about its periphery to help position the panels during installation. These bosses may actually interfere with the panel during removal operations, causing a "trap door" effect, i.e., if a user inadvertently rotates the panel during removal, the resulting resistance of panel to head may damage or even fracture the pedestal head in the removal process.

There is a need for a panel perforation pattern that causes minimal caster, or other wheel, chatter, which permits good airflow, and which is attractive. There also is also a need for panels that may be precisely aligned and which form continuous smooth joints with adjacent panels. There also is a need for panels having a high load carrying capacity, particularly at panel interfaces.

SUMMARY OF THE INVENTION

Flooring systems in accordance with the present invention include a metal raised access flooring panel made up of a generally planar surface or "plate" and an underlying support structure or "grid." The plate and grid may be integrally formed by casting, or may be assembled from separate parts, i.e., the panel may be manufactured by casting or assembly. The panel of the present invention may be produced in a variety of materials, particularly, but not limited to, steel, stainless steel, aluminum and composites.

The grid includes a rectilinear grid of support beams or ribs that may be positioned on the underside of the plate to provide strength. The grid, which may be fabricated or cast from aluminum or steel, has sufficient structural integrity to prevent the panel from deflecting beyond predetermined limits. The dimensions of such a grid may vary; however, dimensions and rib positions minimizing obstruction of air passages are desirable. Moreover, the diagonal ribs are positioned such that most objects positioned on the panel are always supported by a rib, thereby minimizing even the minute deflection that might occur between ribs as well as providing other stress, vibrational and acoustic benefits.

The plate may be solid or perforated by oval, oblong or similarly shaped slots having major axes not parallel to any plate edge. The major slot axes may, for instance, be at a 45° angle to each plate edge. The slots may be arranged in "clusters" of six slots, with one pair of slots above another pair and one slot to each side of, and mid-way above and below, the stacked pairs. Openings in plate corners provide a way to lock the panel in position by passing screws or other fasteners through such openings and into underlying access floor structure.

Alternatively, the plates may be perforated by circular holes arranged in a similar pattern similar to that described above. In another alternative, the plate may be perforated in a manner generally coextensive with the underlying grid, forming a grate which provides the desired structural characteristics with improved airflow.

The arrangement of the slots or holes provides an attractive-looking pattern that facilitates substantial airflow through the panel while essentially eliminating wheel chatter and bouncing when appropriately sized wheeled carts and other equipment are rolled across the panel, thereby making it highly desirable for use in clean room environments where delicate materials are handled.

Flooring systems of the present invention also may include support pins that protrude from each side of the panel. The pins are positioned to correspond to receiver holes in adjacent panels. The pins ensure that adjacent panels continue to lie in essentially the same plane under loads. The pins also distribute loads on one panel to adjacent panels to provide additional strength and to minimize differentials in height between panels, especially as a rolling load is traversed across the floor from panel to panel.

Flooring systems of the present invention also include universal pedestal heads that allow a single pedestal head design to be used with panels of different size. The pedestal head also includes a central boss which allows proper positioning of the panel without creating the risk of pedestal head fracture from "trap-dooring." Similarly, stringers for interconnecting the pedestal heads also are adapted to function with panels of different size.

Carpet or various types of tiles may be placed on or laminated to the panels for decorative or functional reasons. The tiles may have perforations which correspond to any perforations in the panels. The perforations in the tile may be made slightly smaller than the perforations in the panel; thus, any slight misalignment between the tiles and the panels will not be apparent.

Accordingly, it is an object of the present invention to provide panels for use in raised flooring systems which have a high load carrying capacity.

Another object of the present invention is to provide panels for use in raised flooring systems which allow airflow therethrough.

Yet another object of the present invention is to provide panels for use in raised flooring systems which minimize impact loads experienced by cars or other objects moving across panels.

A flier object of the present invention is to provide panels for use in raised flooring systems which minimize impact loads experienced by cars or other objects moving between adjacent panels.

Another object of the present invention is to provide systems for supporting panels in raised flooring systems in which the same hardware may be used for panels of different sizes.

The above-described features and benefits, as well as other benefits of the panel of the present invention will be understood by those skilled in the art by reference to the accompanying drawings and the following detailed description of those drawings.

BRIEF DESCRIPTION OF THE DRAWINGS

FIG. 9 is a bottom view of a second alternative embodiment of a cast floor panel having a grate surface in accordance with the present invention.

FIG. 9A is a side view of the floor panel of FIG. 9.

FIG. 9B is a cross-section taken along line B—B in FIG. 9.

FIG. 9C is a plan view of an alternate embodiment of the perforation pattern of the panel of FIG. 9.

FIG. 10 is a bottom view of a third alternative embodiment of a cast floor panel having a solid surface in accordance with the present invention.

FIG. 10B is a side view of the floor panel of FIG. 10.

FIG. 12 is a bottom view of a fifth alternative embodiment of a cast floor panel having a perforated surface in accordance with the present invention.

FIG. 18 is a top plan view of a pedestal head in accordance with the present invention.

FIG. 18A is a cross-section of the head of FIG. 18 taken along line 18A—18A.

FIG. 18C is a side view of the head of FIG. 18 taken perpendicular to line 18A—18A with portions of the head removed for clarity.

FIG. 18D is a side view of the head of FIG. 18 taken perpendicular to line 18B—18B with portions of the head removed for clarity.

DETAILED DESCRIPTION

Figure 1:
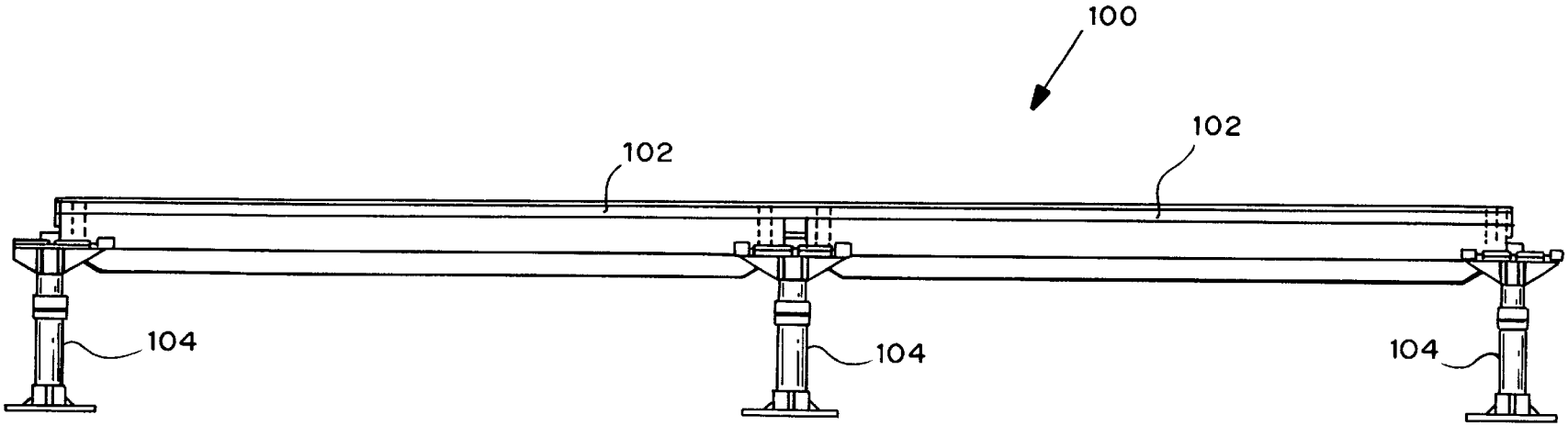
FIG. 1 shows a support structure for use with floor panels of the present invention.
Figure 2:
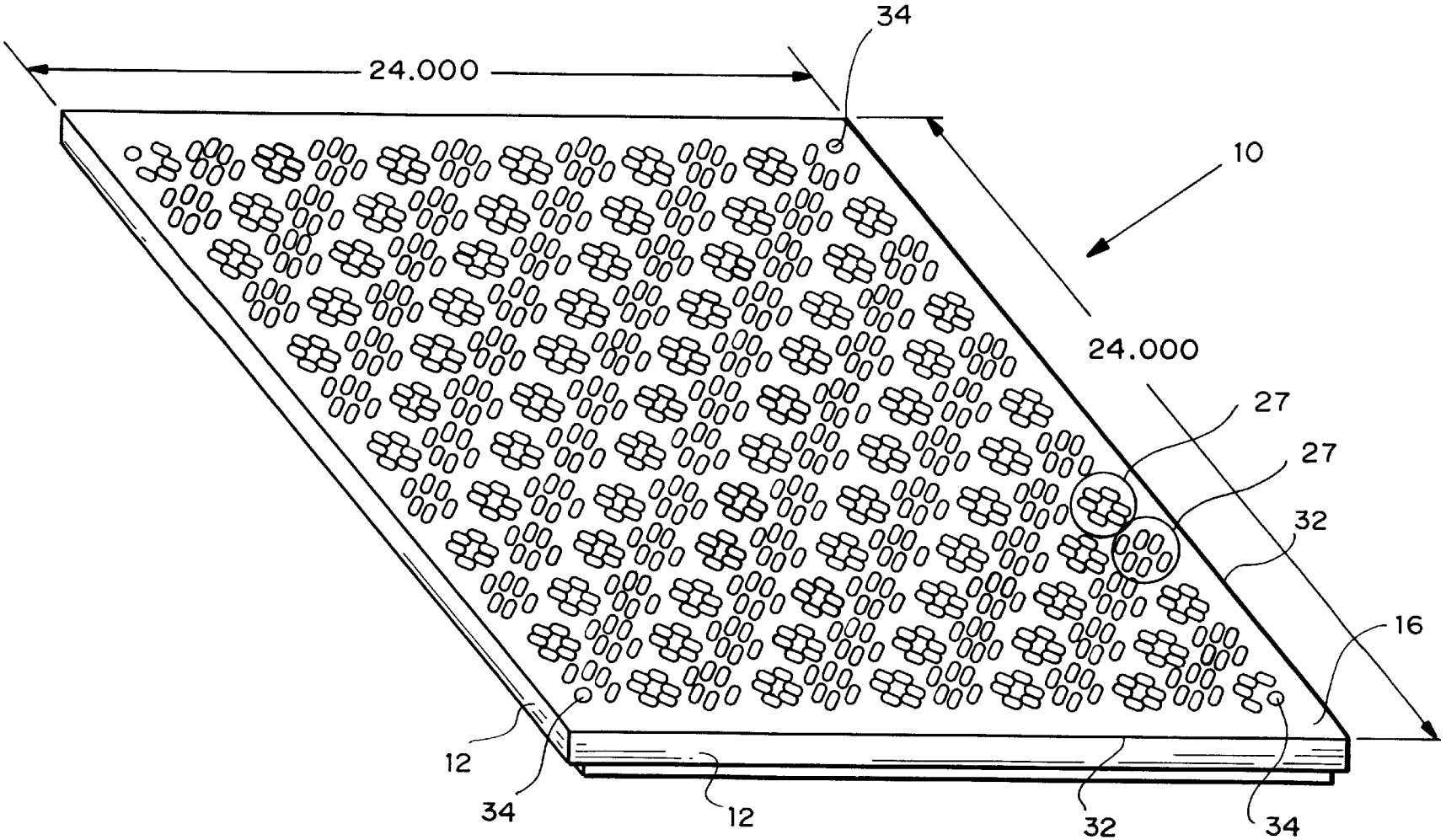
FIG. 2 is a perspective view of a fabricated floor panel in accordance with the present invention.

Referring to FIG. 1, a support structure 100 may support a plurality of flooring panels 102. Typically, these panels are made of steel, stainless steel or aluminum, but other materials, such as composites, could be used in some applications. The panels may be affixed to the structure with fasteners or may simply rest on the structure. In either case, the panels may be readily removed for access to the subfloor (i.e., the area 104 below panels 102) and any wiring, ductwork or other infrastructure elements routed in the subfloor.

Panels 102 may be treated to provide any number of desirable surface qualities. For instance, carpet tile or other suitable floor treatments may be applied to the surface of each panel for decorative and functional purposes, such as sound attenuation, conductivity control and other desirable functions. The panels may be epoxy coated or plated to provide desirable properties such as static control, wear resistance, protection against chemical spills, etc. Alternatively, the panel may be left bare but may be laminated with a tile to provide a protective wear surface.

FIGS. 2–8 illustrate a fabricated embodiment of a floor panel 10 in accordance with the present invention. The size of panel 10 will typically be nominally twenty-four inches by twenty-four inches (an "English" panel) or 600 millimeters by 600 millimeters (a "Metric" panel), but some applications may utilize panels 10 that are nominally eighteen inches square or one-half meter square, and other sizes, such as 750 millimeters by 750 millimeters and 500 millimeters by 500 millimeters, also readily may be fabricated. Other dimensions may be selected as desired in order to match the panel 10 to a selected support structure. Panel 10 is made up of four side ribs 12, substructure grid 14 and cover plate 16.

Figure 3:
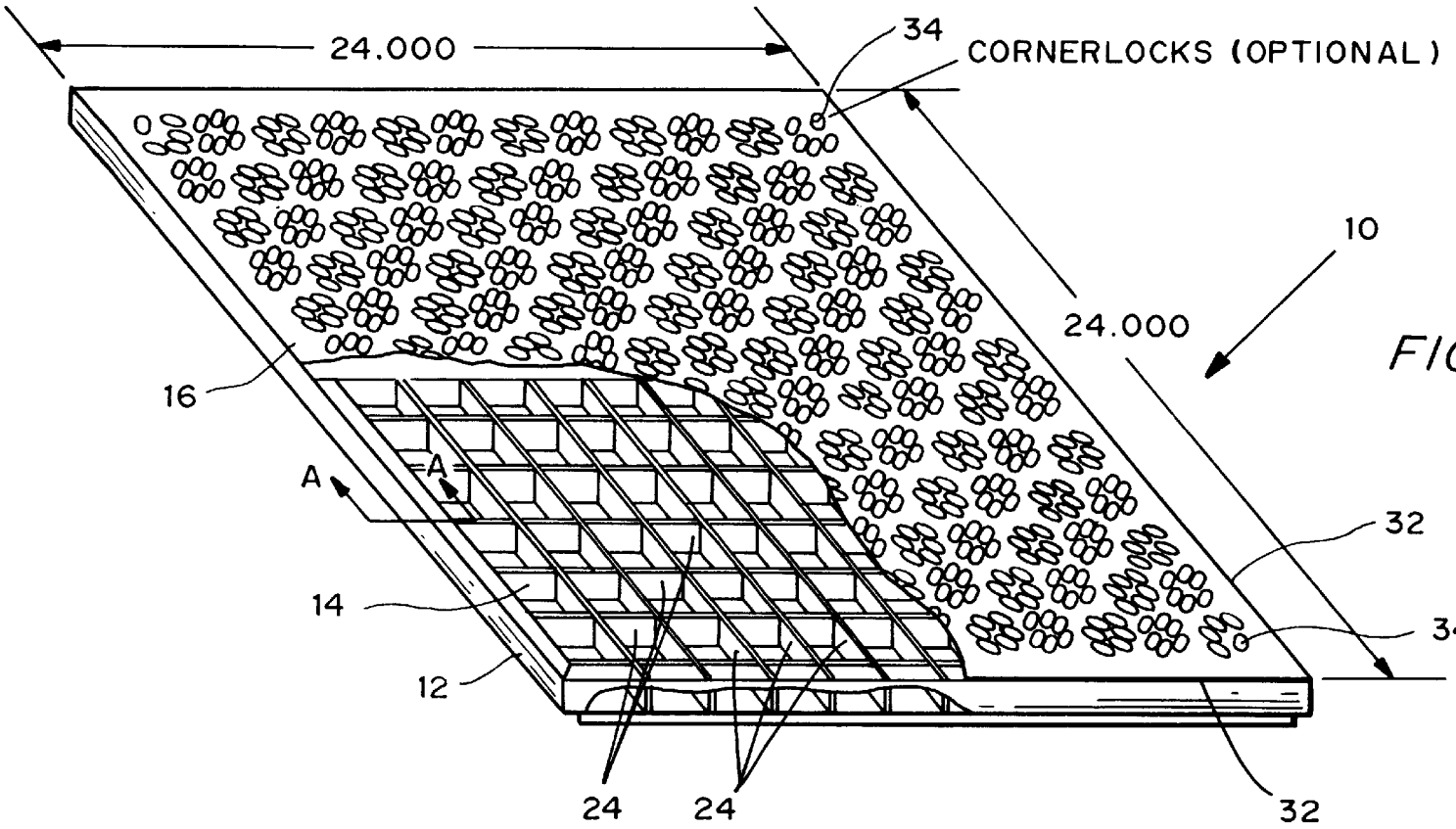
FIG. 3 is a perspective view of the floor panel of FIG. 2, with portions cut away to show underling structure.
Figure 3A:
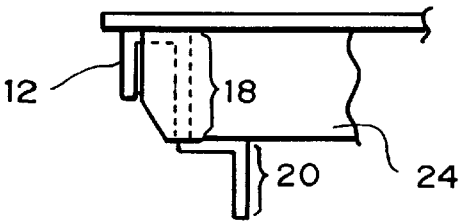
FIG. 3A is a partial cross-section of the floor panel of FIG. 3 taken along line A—A of FIG. 3.
Figure 5:
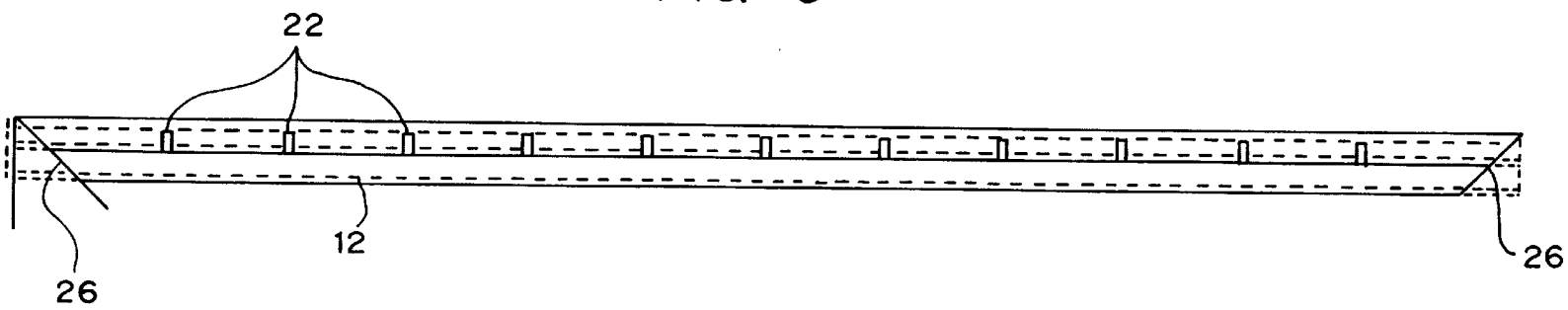
FIG. 5 is a top plan view of the border rib of the floor panel of FIG. 2.
Figure 5A:
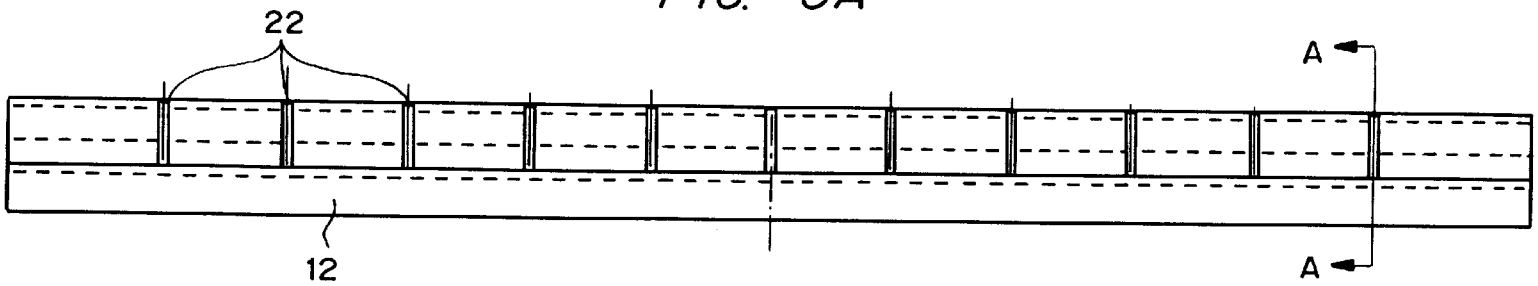
FIG. 5A is a side elevation view of the border rib of FIG. 5.
Figure 5B:
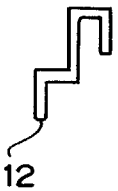
FIG. 5B is an end elevation view of the border rib of FIG. 5.
Figure 5C:
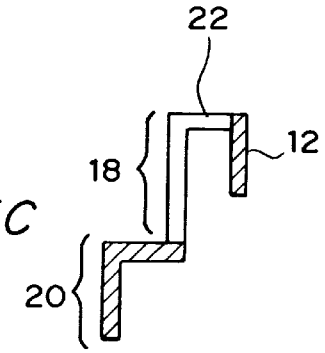
FIG. 5C is cross-section view of the border rib of FIG. 5 taken along line A—A of FIG. 5A.
Figure 6:
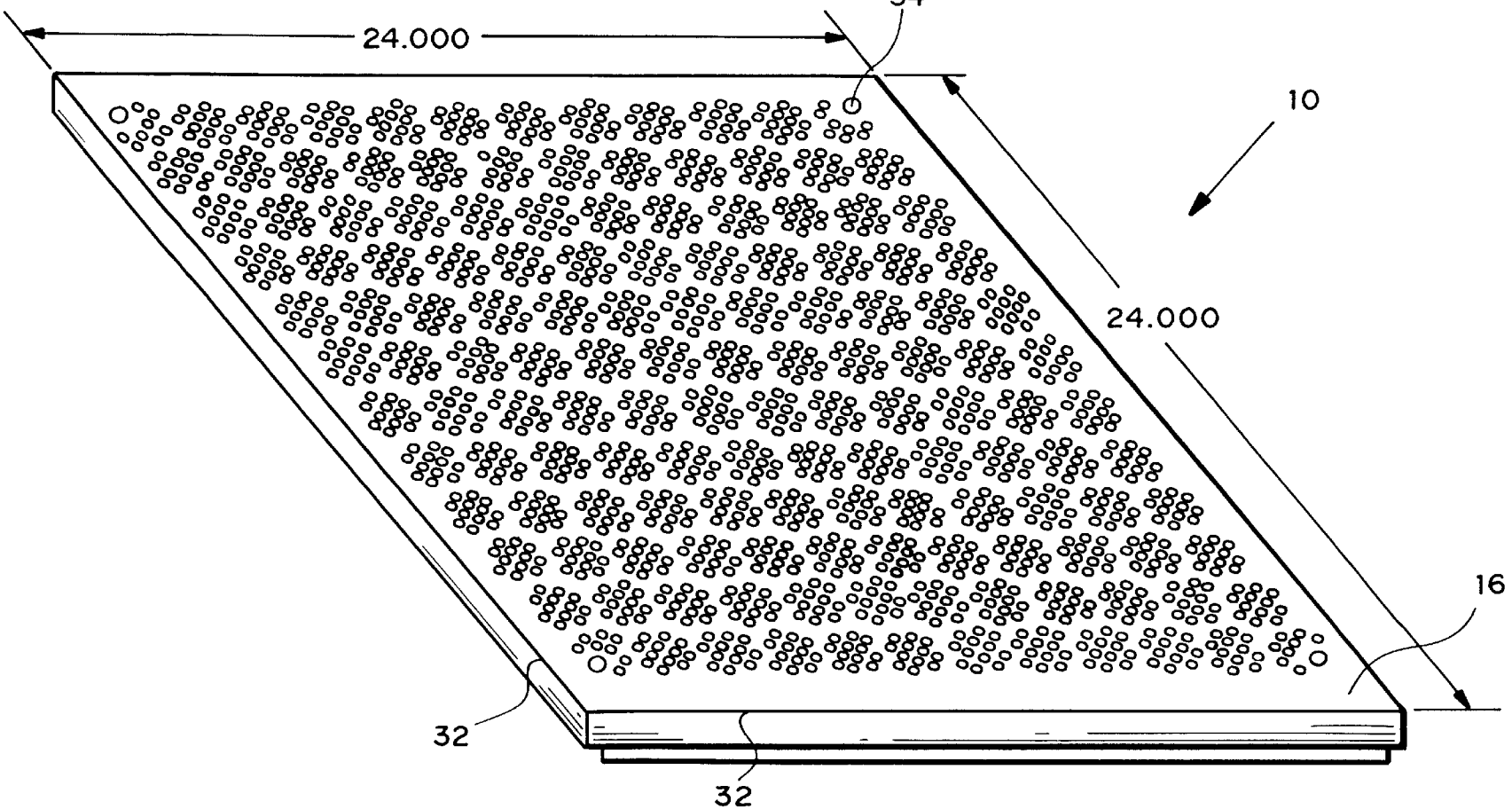
FIG. 6 is a perspective view of a first alternative embodiment of a fabricated floor panel in accordance with the present invention.
Figure 7:
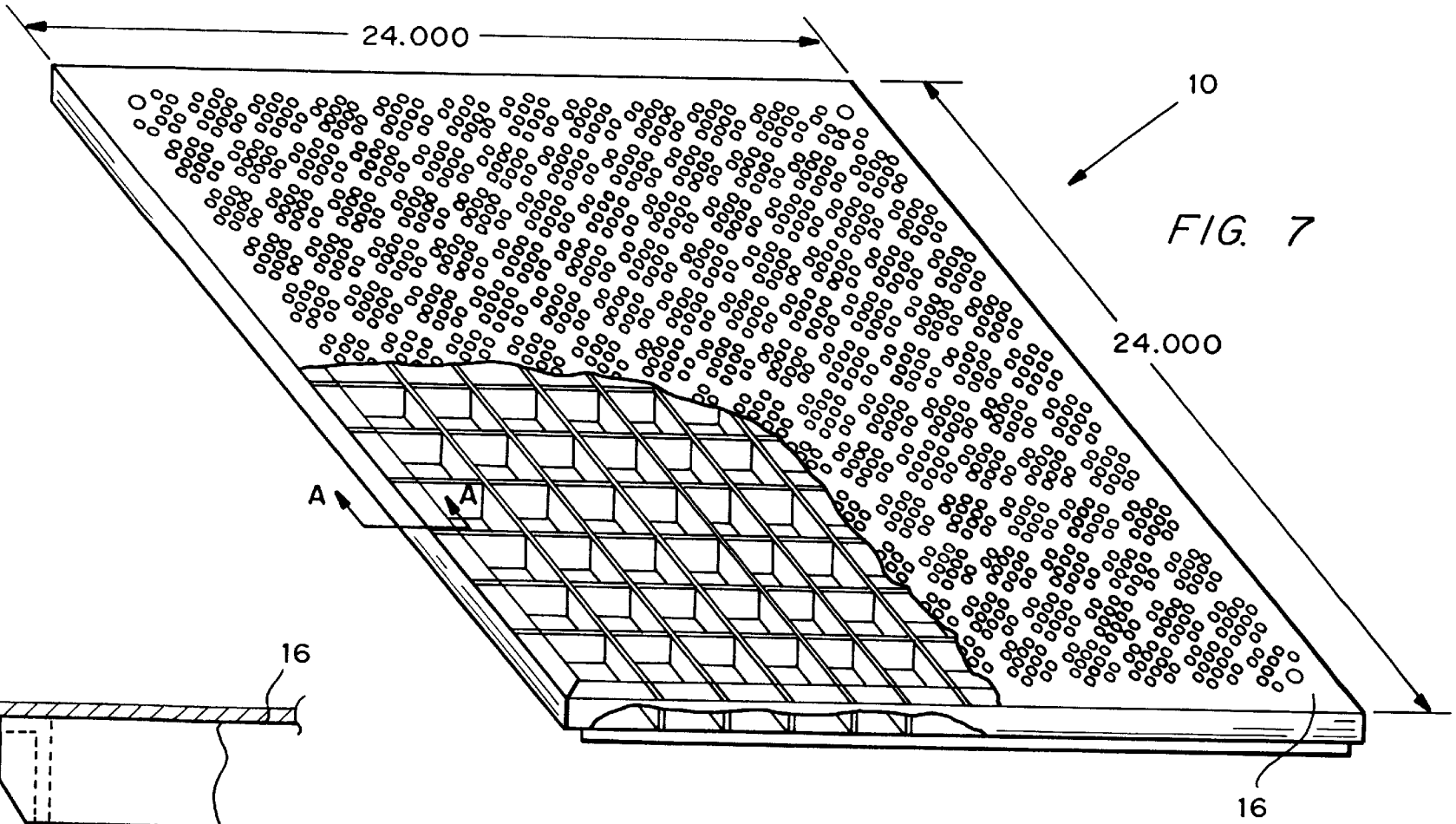
FIG. 7 is a perspective view of the floor panel of FIG. 6 with a portion cut away to show underlying structure.
Figure 7A:
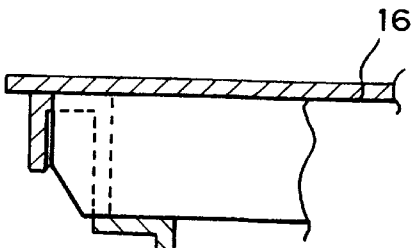
FIG. 7A is a partial cross-section of the floor panel of FIG. 6 taken along line A—A of FIG. 7.

As shown in FIGS. 5–5C, side ribs 12 have a "U"-shaped channel portion 18 and a "L"-shaped stiffener portion 20. Channel portion 18 has a plurality of engaging slots 22 which receive cross-members 24 of grid 14 (see FIG. 3A). Stiffener portion 20 runs uninterrupted along the length of rib 12. Stiffener portion 20 serves to stiffen rib 12, thereby providing additional resistance to sagging or warping of panel 10 along its edges. Stiffener portions 20 may also cooperate with a support structure (not shown) to help properly locate the panel thereon. Ends 26 of ribs 12 may be mitered so as to allow a square joint between ribs 12 at each corner of panel 10. Ribs 12 may be formed by conventional bending, extruding or molding techniques utilizing steel, stainless steel, aluminum, other metals or alloys of metals or composite materials. Alternatively, channel forms may also be utilized. Ribs 12 may be attached to the underside of plate 16 with adhesive, welding, brazing, silver solder, rivets or other fastening means.

Grid 14 is made up of a plurality of cross-members 24 which are joined in such a manner as to form an interlocking grid. Cross-members 24 may all be continuous, having notches to allow interlocking, or may be discontinuous and joined by welding or some other appropriate affixing means. For instance, cross-members 24 may be formed into the intersecting structure illustrated in FIG. 3 by forming slots (not shown) part-way through each cross-member, and positioning a first cross-member 24 with a downward facing slot at the point where an upward facing slot is located in the second cross-member 24. Grid 14 serves to stiffen the entire panel and counteract warping or sagging, particularly in the central portion of the panel. In the embodiment illustrated in FIGS. 2–8, cross-members 24 are made of steel, although stainless steel, aluminum stock or other materials may be used as appropriate. Cross-members 24 may be formed by stamping, extrusion, molding, forging or any other appropriate method. The thickness of cross-members 24 may range between 0.125 and 0.350 inches, and the depth of cross-members may typically be between approximately one and two and one-half inches.

Cover plate 16 provides a substantially continuous surface covering grid 14. The thickness of plate 16 will vary depending on the material used, the size of the floor panel 10 in which the plate 16 is used, the strength of the underlying support structure, the size of slots 28, the load bearing and other requirements of the installation where the panel 10 is to be used and other factors.

Plate 16 is perforated with a plurality of slots 28. Plate 16 may be formed by stamping or otherwise machining the slots 28 and holes 34 in a steel, aluminum or plastic plate or sheet. Slot 28 dimensions and shapes may vary. For instance, slot 28 length may be about 0.69 inch, and slot width may be about 0.29 inch. Slots 28 are positioned on plate 16 so as to correspond to grid 14 such that none of slots 28 overlap with a cross-member 24 of grid 14.

Figures 4, 4A:
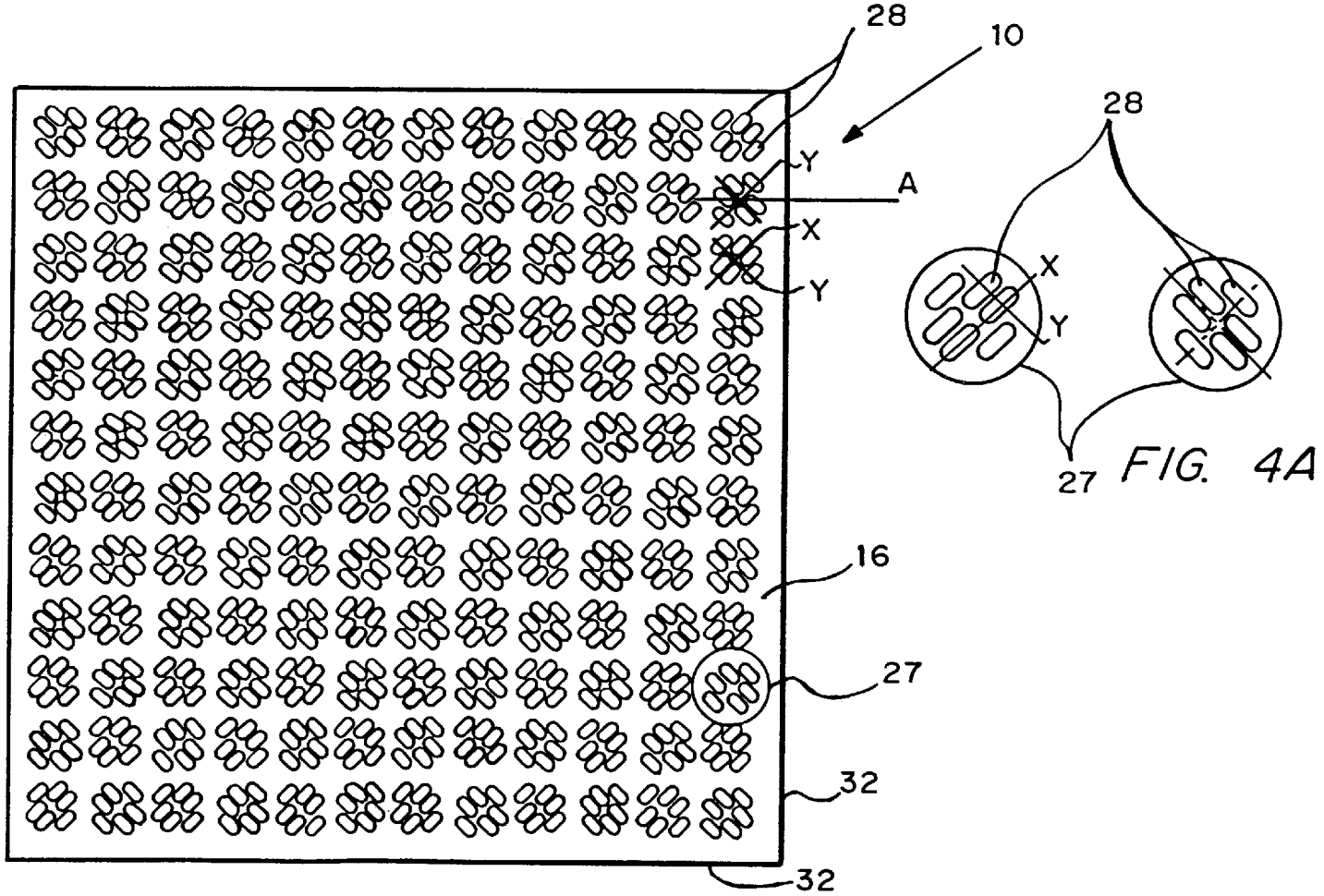
FIG. 4 is a top plan view of the top plate of the floor panel of FIG. 2.
FIG. 4A is a detail of two clusters of slots of the plate of FIG. 4

As may be seen by reference to FIGS. 2–4A, slots 28 are arranged in "clusters" 27 of six slots 28, in which one pair of slots 28 is located above another pair of slots 28, and yet another slot is located on each side of the two pairs, equally distant above one pair and below the other. Significantly, as shown in FIGS. 4 and 4A, neither the major axis "x" nor the minor axis "y" of the slots 28 is parallel to any edge 32 of plate 16. In the embodiment illustrated in FIG. 4, each of the major axes "x" and minor axes "y" forms a 45° angle A with the edges 32 of plate 16. This orientation means that a wheel traveling parallel to an edge 32 across a slot 28 in plate 16 never aligns itself with major axis "x" of a slot 28. Angle A may also be angles other than 45° but should not be 90° or any angle closely approximating 90°.

Optional holes 34 may be located near the corners of plate 16 so that screws or other fasteners can be passed through holes 34 and into underlying structure to lock panels 10 in place. As maybe seen by reference to FIGS. 2–3, each such hole 32 in effect replaces one pair of slots 28 in a cluster 27.

Cover plate 16 may be covered with a decorative or functional treatment (not shown) such as a carpet, tile, or other floor covering. The treatment may have perforations which correspond to slots 28. The perforations in the treatment may be sized slightly smaller than slots 28 so that minor imperfections in alignment between plate 16 and the treatment will not result in plate 16 being visible through or forming a "ledge" below the perforations. For instance, if the dimensions of slots 28 are 0.690 by 0.290 inches, the perforations may have dimensions of 0.662×0.262 inches.

Figure 8A:
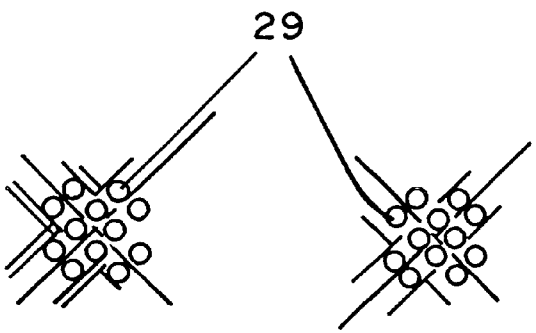
FIG. 8A is a detail of the round perforations of the plate of FIG. 6.
Figure 8:
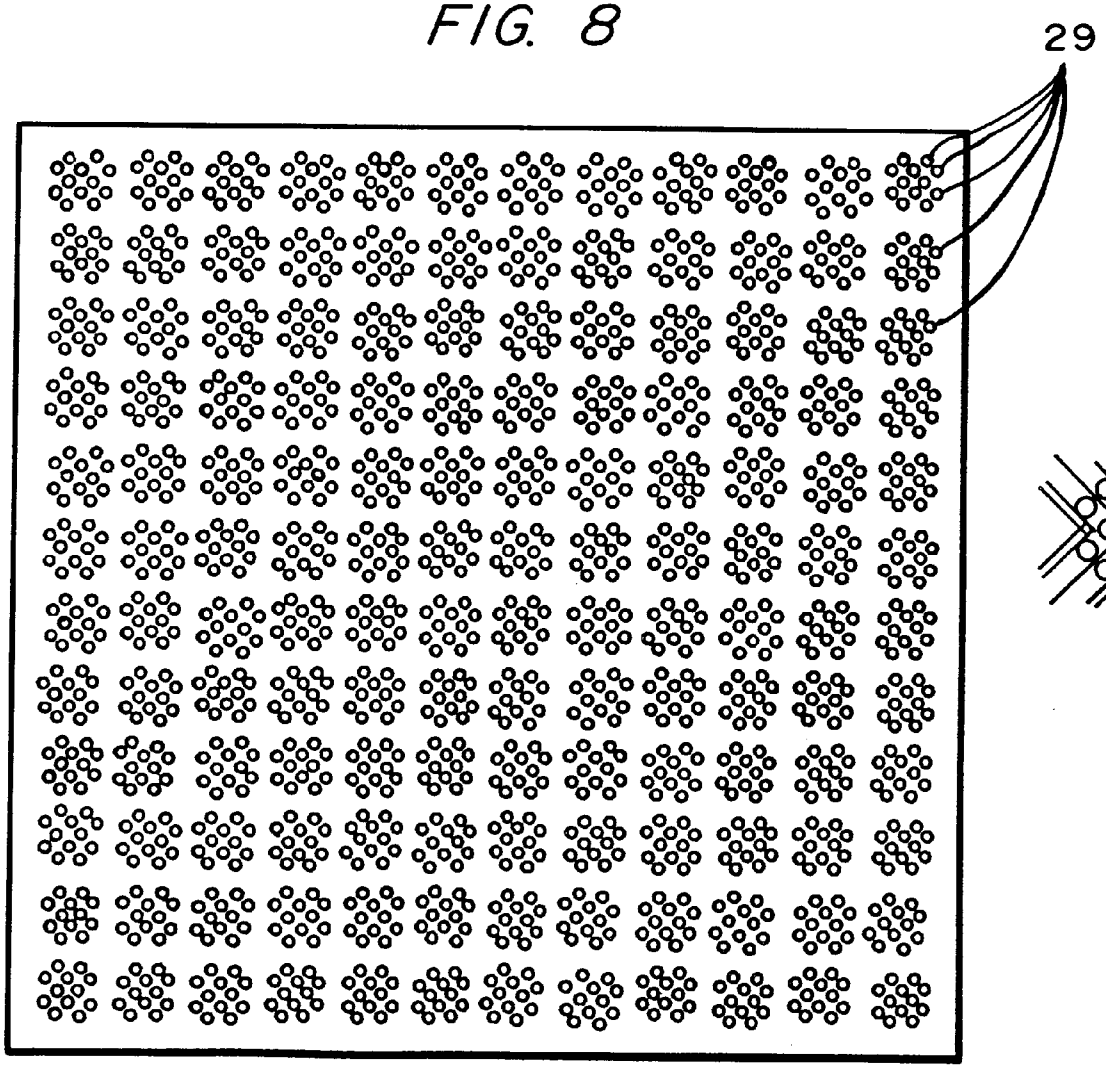
FIG. 8 is a top plan view of the top plate of the floor panel of FIG. 6.

FIGS. 6 through 8A show an alternative embodiment of floor panel 10. The materials and construction of the alternate embodiment are essentially the same as described above, except that cover plate 16 is perforated with a plurality of round holes 29 instead of slots 28. Round holes 29 have a diameter of about 0.294 inch and are arranged as shown in FIGS. 8 and 8A. Any treatment (not shown) which is applied to plate 16 may have corresponding holes which, as described above, may be slightly smaller than holes 29 so that plate 16 is not visible and does not form a "ledge" if the holes in the treatment are not perfectly aligned with holes 29.

The perforation pattern of the present invention provides an attractive looking pattern that facilitates substantial airflow through the panel. The use of slots 28 illustrated dimensions provides an airflow area of about 30%, whereas use of holes 29 provides an airflow area of about 20%.

It should be understood that a wide range of different underlying structures may be substituted for the illustrated structure using cross-members 24 and ribs 12. A plate 16 in accordance with the present invention may even be used in some installations without any attached underlying structure where the composition of plate 16 is sufficiently strong to permit it (in light of the access flooring support structure involved) to bear the required loads in a particular installation. Similarly, grid 14 may be used without plate 16 if the density of cross-members 24 is sufficient to provide a stable surface for use. For example, in clean room environments it may be desirable to provide panels 10 with maximum deflections under load of between about L/240 to L/300 where L is the span of the panel 10. For conventional panel sizes, this deflection is about eighty to one hundred thousandths of and inch. More sensitive environments may require even stronger panels 10, white less sensitive environments may tolerate panels which undergo more substantial deflection under load.

FIGS. 9 through 12 show cast embodiments of a floor panel 50 in accordance with the present invention with a grate (FIG. 9); a solid plate 52 (FIG. 10); oblong perforations, or slots, 60 (FIG. 11); or round perforations, or holes, 62 (FIG. 12), in plate 52. The slots 60 or holes 62 are positioned on plate 52 in the manner described above and shown in FIGS. 11 and 12, respectively.

Unlike the fabricated embodiments described with reference to FIGS. 2 through 8, cast floor panel 50 is cast in a single piece, preferably from aluminum. Other materials may be selected, as appropriate to provide the desired strength. Panel 50 comprises floor plate 52, peripheral ribs 54, cross-members 56 and reinforcing ribs 58.

Figure 10A:
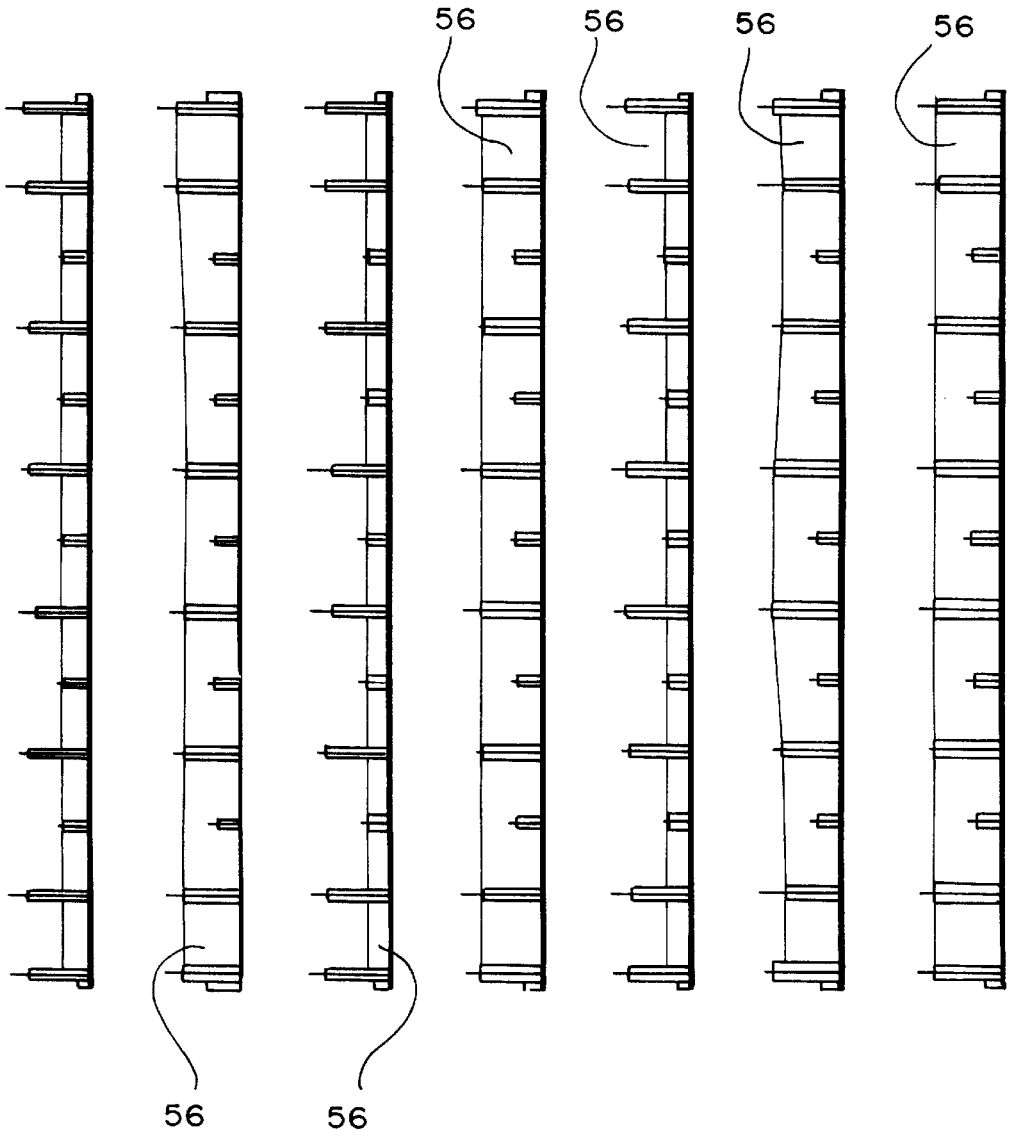
FIG. 10A is a series of section views of the floor panel of FIG. 10.

Ribs 54 are provided along each edge of panel 50 and protrude from the underside of plate 52. Machined areas 68 may be provided to act as registers for aligning or otherwise seating panel 50 on a support structure (see FIG. 1). As shown in FIG. 9B and 10A, rib 54 may be relatively thick compared to cross-members 56 and may have a thickened section at its base to provided additional rigidity. Cross-members 56 also protrude from and extend across the underside of plate 52 to form a grid. Cross-members 56 may be varied in height both with respect to each other and along their lengths, as shown in FIG. 10A, in order to minimize the weight of panel 50 while maximizing strength of panel 50 where appropriate.

Figure 11:
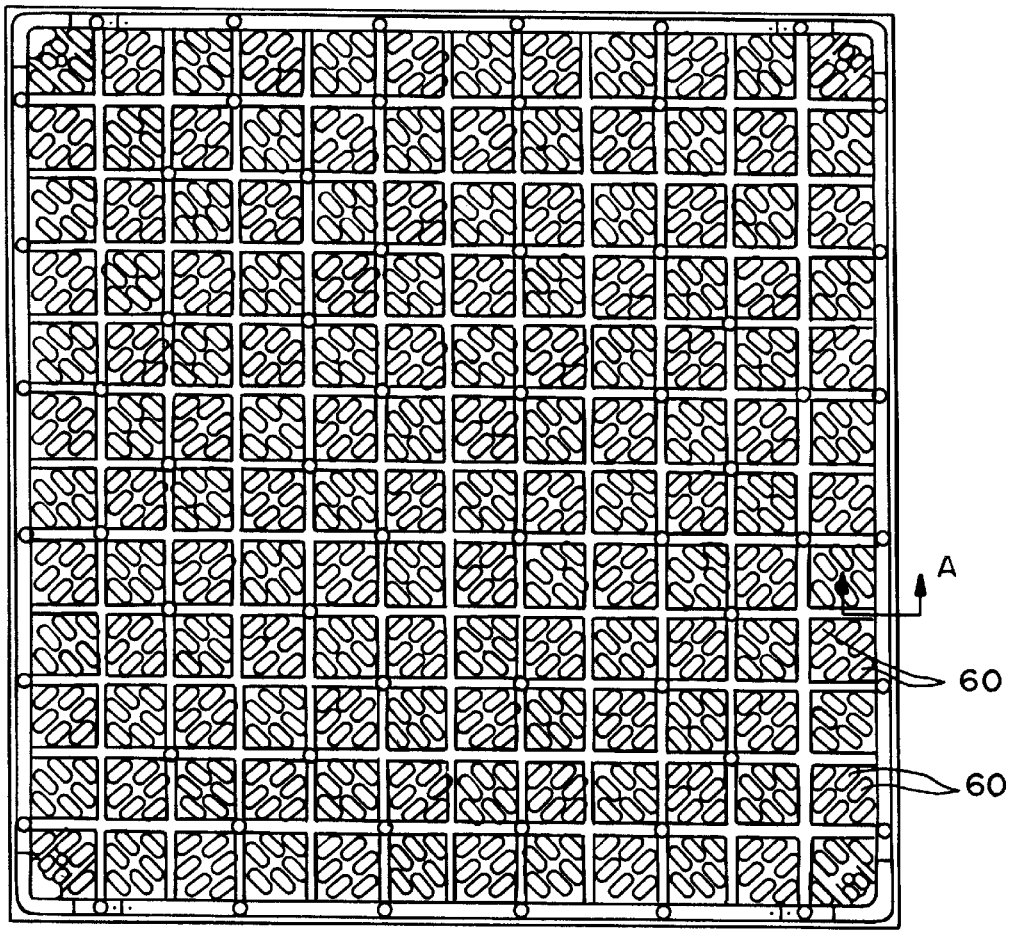
FIG. 11 is a bottom view of a fourth alternative embodiment of a cast floor panel having a perforated surface in accordance with the present invention.
Figure 12A:
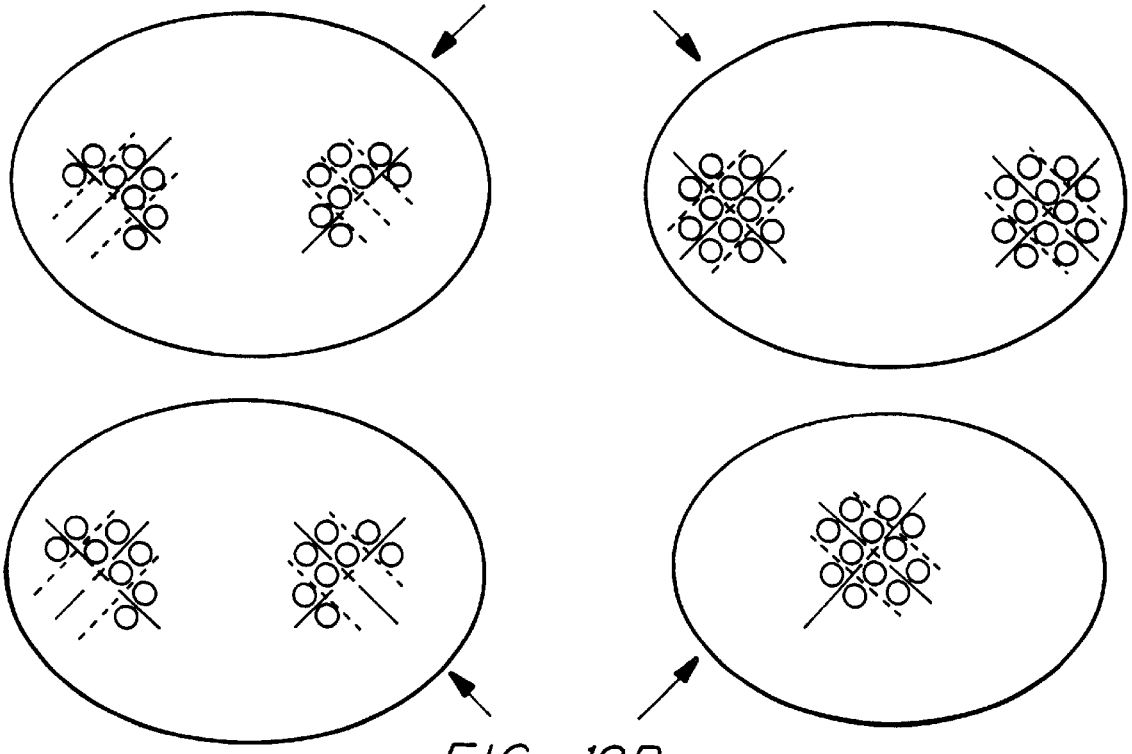
FIG. 12A is a detail view of the holes in the floor panel of FIG. 12.

Ribs 58 protrude from the underside of plate 52 about half as far as ribs 54; however, other relative heights are possible and may be desirable for certain applications. Ribs 58 are positioned diagonally with respect to cross-members 56 so as to create triangular, diamond, or truncated (as shown in FIG. 9C) patterns surrounding alternating junctions of cross-members 56. As shown in FIGS. 11 and 12, this pattern coincides with the pattern of slots 60 or holes 62, thereby avoiding blockage of any perforations and ensuring the desired flow of air.

The thickness and height of ribs 54 and 58 and cross-members 56 may be varied as appropriate to achieve the desired load bearing strength of panel 10.

As shown in FIG. 9, panel 50 may be cast without plate 52 to provide a floor grate. Such a floor grate will provide an airflow of about 55%. The upper portions of the ribs and cross members may flare or crown slightly to provide additional surface area.

Figure 11C:
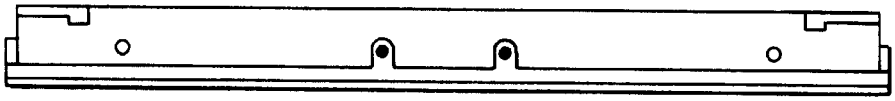
FIG. 11C is a partial cross-section of the floor panel of FIG. 11.
Figure 11C:
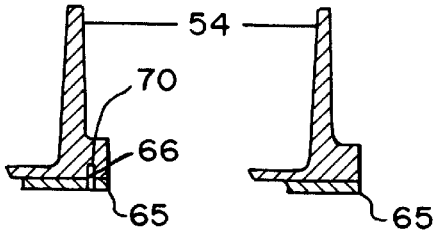
Figure 11A:
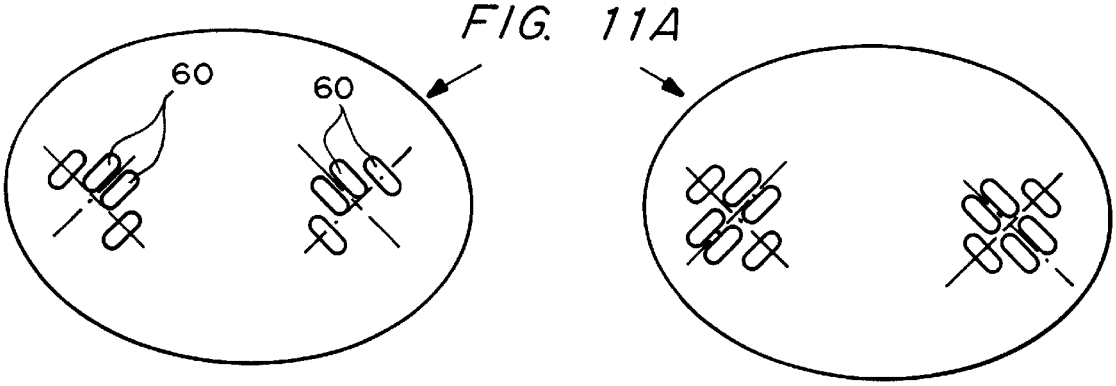
FIG. 11A is a detail view of the slots in the floor panel of FIG. 1.
Figure 11B:
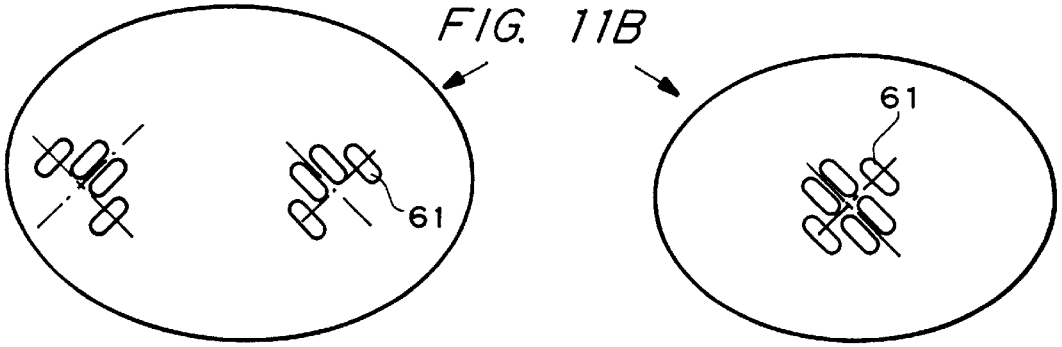
FIG. 11B is a detail view of the slots in a tile corresponding to the floor panel of FIG. 11.
Figure 11B:
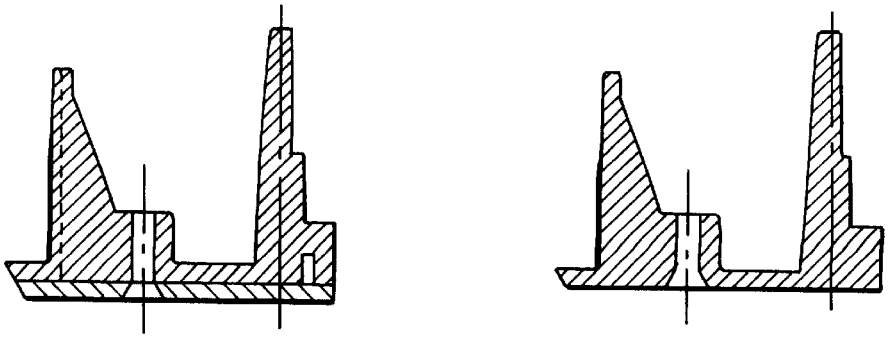
Figure 12B:
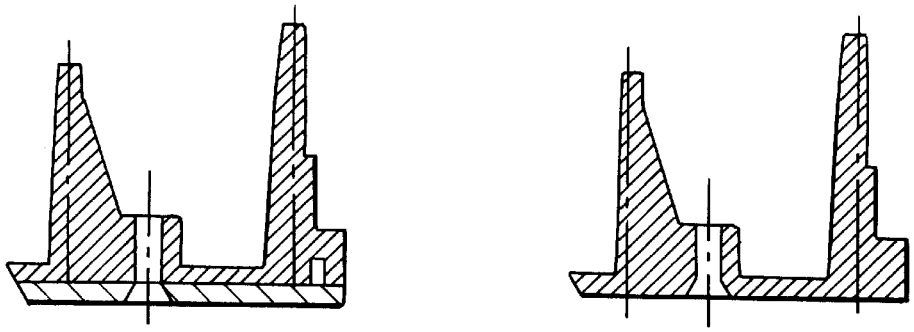
FIG. 12B is a detail view of the holes in a tile corresponding to the floor panel of FIG. 12.

FIGS. 11B and 12B illustrate the dimensions of slots 61 and holes 63 of a treatment 65 (shown in FIG. 11C) which correspond to slots and holes 60 and 62. As described above, slots and holes 61 and 63 are slightly smaller than slots and holes 60 and 62 in order to conceal any slight misalignments between treatment 65 and panel 50. As shown in FIG. 11C, a groove 70 may be provided about the periphery of plate 52 for securing a decorative trim strip 66 or other treatment in place. Rib 54 may be butted sufficiently to provide an adequate thickness in the area where groove 70 is positioned. Other grooves may be provide on the surface of plate 52 as desired to receive aesthetically pleasing trim strips or other decorative or functional treatments.

The above-described panels 10 and 50 and their various embodiments may be fabricated or cast, as appropriate, from a variety of materials including, but not limited to carbon steel, stainless steel or aluminum. The panels may be finished as desired or left bare. Finished may include paint, epoxy coating (including conductive epoxy), plating (such as nickel chrome or autocatalytic nickel plating), anodizing or any other desired coating.

As shown in FIGS. 13, 13A, 14, 15, 16A–D and 17A–C, support pins 80 and receiver holes 82 may be provided in ribs 54 of panels 50. Support pins 80 are positioned so as to correspond to receiver holes 82 in adjacent panels 50A. Support pins 80 may be moved into place by means of a rack and pinion or functionally equivalent arrangement. Support pins 80 may have gear teeth 84 along one side or "teeth" in the form of annular rings or a spiral machine, box or other thread for engagement with the pinion. A shaft 88 having a gear 86 at one end is inserted into an ejector pin boss or access port adjacent to support pin 80. The gear 86 (the pinion) acts in cooperation with teeth 84 (the rack), to move support pin 80 back and forth into receiver hole 82. Shaft 88 may then be turned with a screwdriver, Allen wrench or other type of tool as desired.

Alternatively, removable tools 90 may be inserted into the access port and rotated to position support pin 80 as desired. Thereafter, tool 90 may be removed and anti-vibration pin 92 may be inserted in boss to reduce the likelihood of vibration causing support pin 80 to inadvertently move out of receiver hole 82. Anti-vibration pin 92 has only a limited number of teeth 94 to engage gear teeth 84. Thus, if support pin 80 begins to move due to vibration or some other undesired force, gear teeth 84 will encounter the smooth portion adjacent to teeth 94 and be inhibited from moving beyond that point. In this manner, support pin 80 is held firmly in place without the need for adhesives or other more permanent fasteners. Anti-vibration pin 92 may also include slot 96 or other removal detail to allow removal of lock pin 92 so that the floor panel may be removed.

Figure 13:
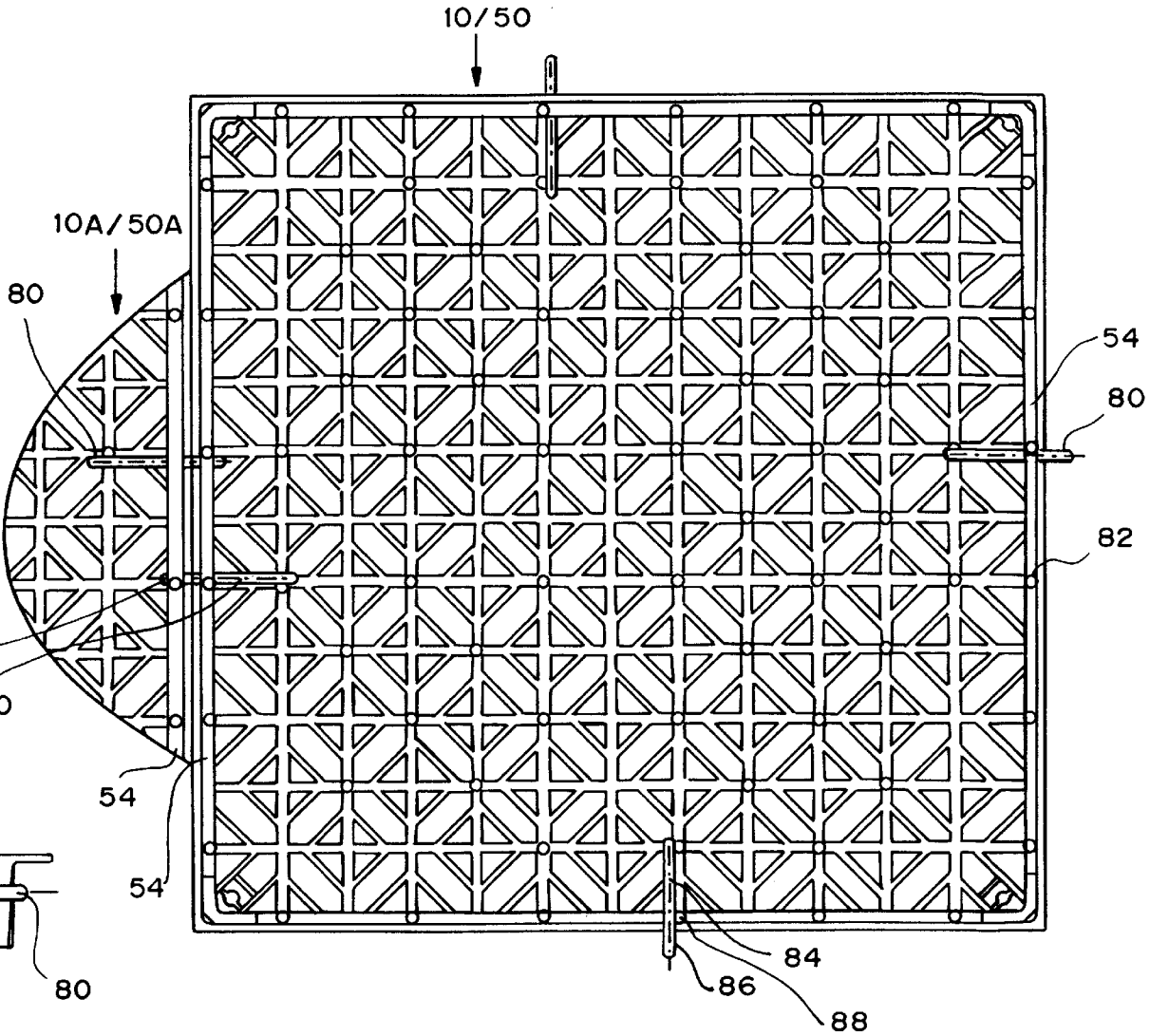
FIG. 13 is a bottom view of a floor panel in accordance with the present invention showing a partial view of an adjacent panel and support pins.
Figure 13A:
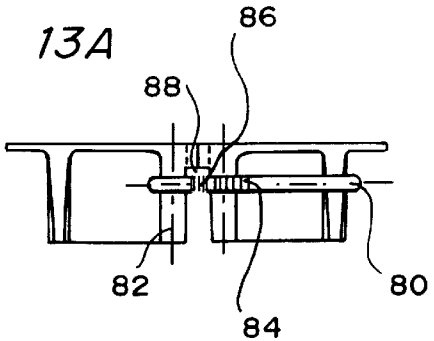
FIG. 13A is a partial cross-section view of a joint between the adjacent panels of FIG. 13.
Figure 14:
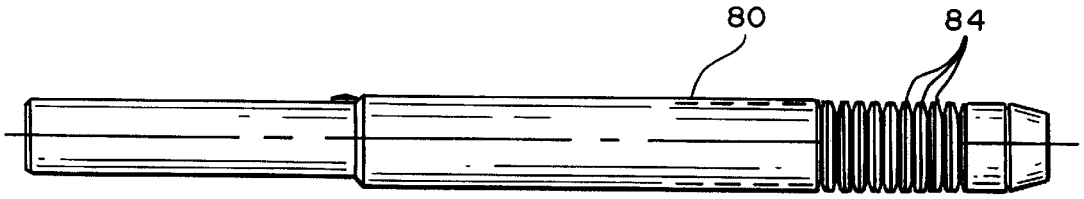
FIG. 14 is a side view of the support pin of FIG. 13A.
Figure 16A:
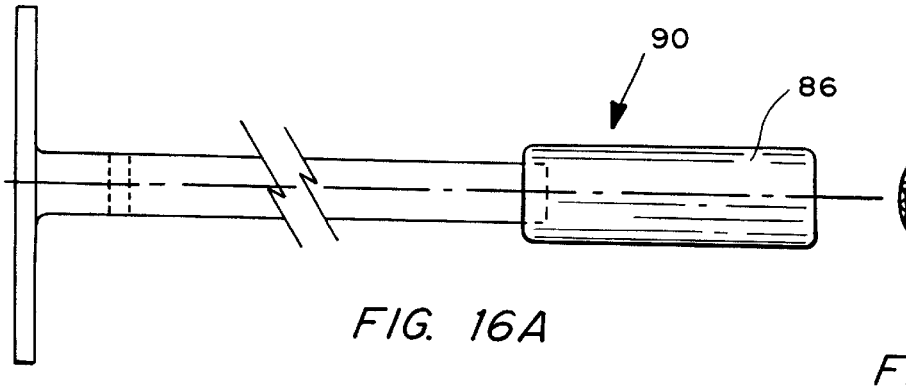
FIG. 16A is a side view of an support pin actuating tool in accordance with the present invention.
Figure 16B:
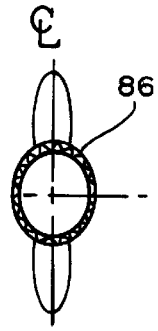
FIG. 16B is an end view of the tool of FIG. 16A.
Figure 16C:
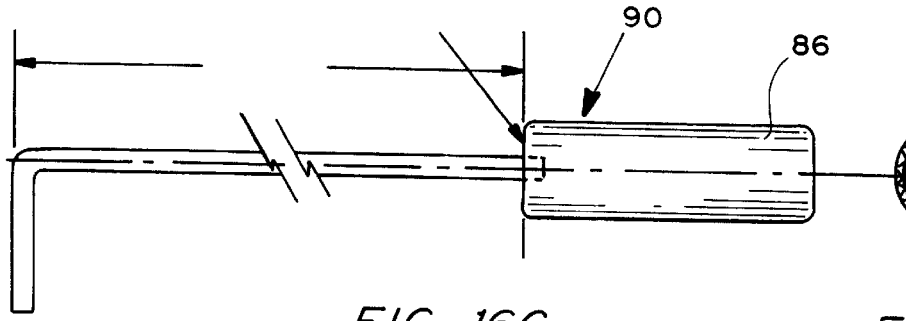
FIG. 16C is a side view of an alternate embodiment of an support pin actuating tool in accordance with the present invention.
Figure 16D:
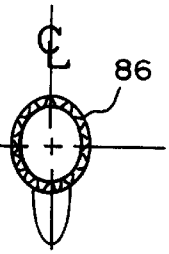
FIG. 16D is an end view of the tool of FIG. 16C.
Figure 15:
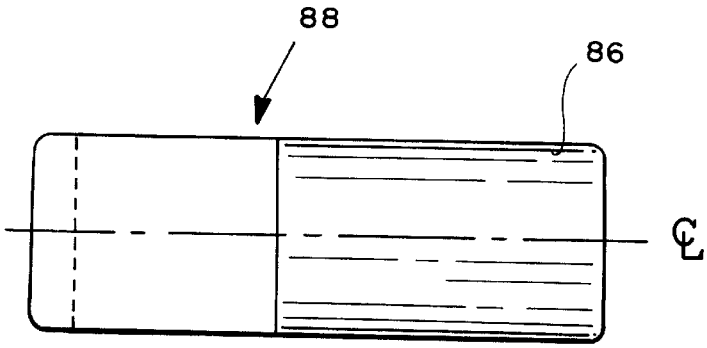
FIG. 15 is a side view of a pinion gear in accordance with the present invention.
Figure 15A:
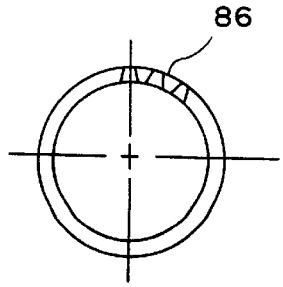
FIG. 15A is and end view of the pinion gear of FIG. 15.

Support pins 80 cooperate with receiver holes 82 to align and strengthen panels 50 by positioning them accurately and distributing loads and/or forces from one panel to another. As is illustrated in FIG. 13, by positioning one pin 80 in the same off-center position in each panel edge of every panel 50, each pair of opposed panel edges may be penetrated by two support pins 80. Of course, any number of support pins and receiver holes may be selected as desired and appropriate to achieve the desired load bearing strength of panel 10. Support pins 80 and receiver holes 82 also may be provided in the panels 10 of the first embodiment illustrated in FIGS. 2–8 and the floor grate illustrated in FIG. 9.

Figure 17B:
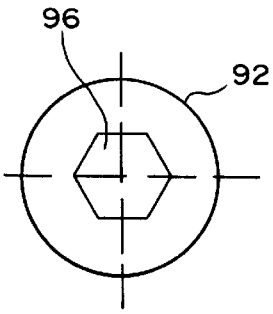
FIG. 17B is a top end view of the pin of FIG. 17A.
Figure 17C:
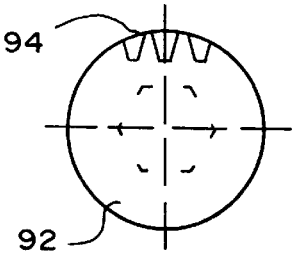
FIG. 17C is a bottom end view of the pin of FIG. 17A.
Figure 17A:
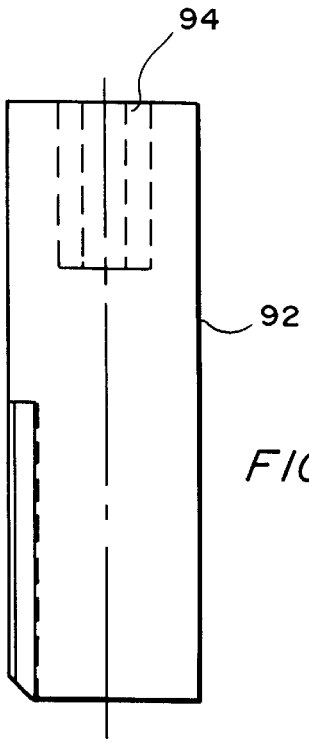
FIG. 17A is a side view of an anti-vibration pin in accordance with the present invention.
Figure 17D:
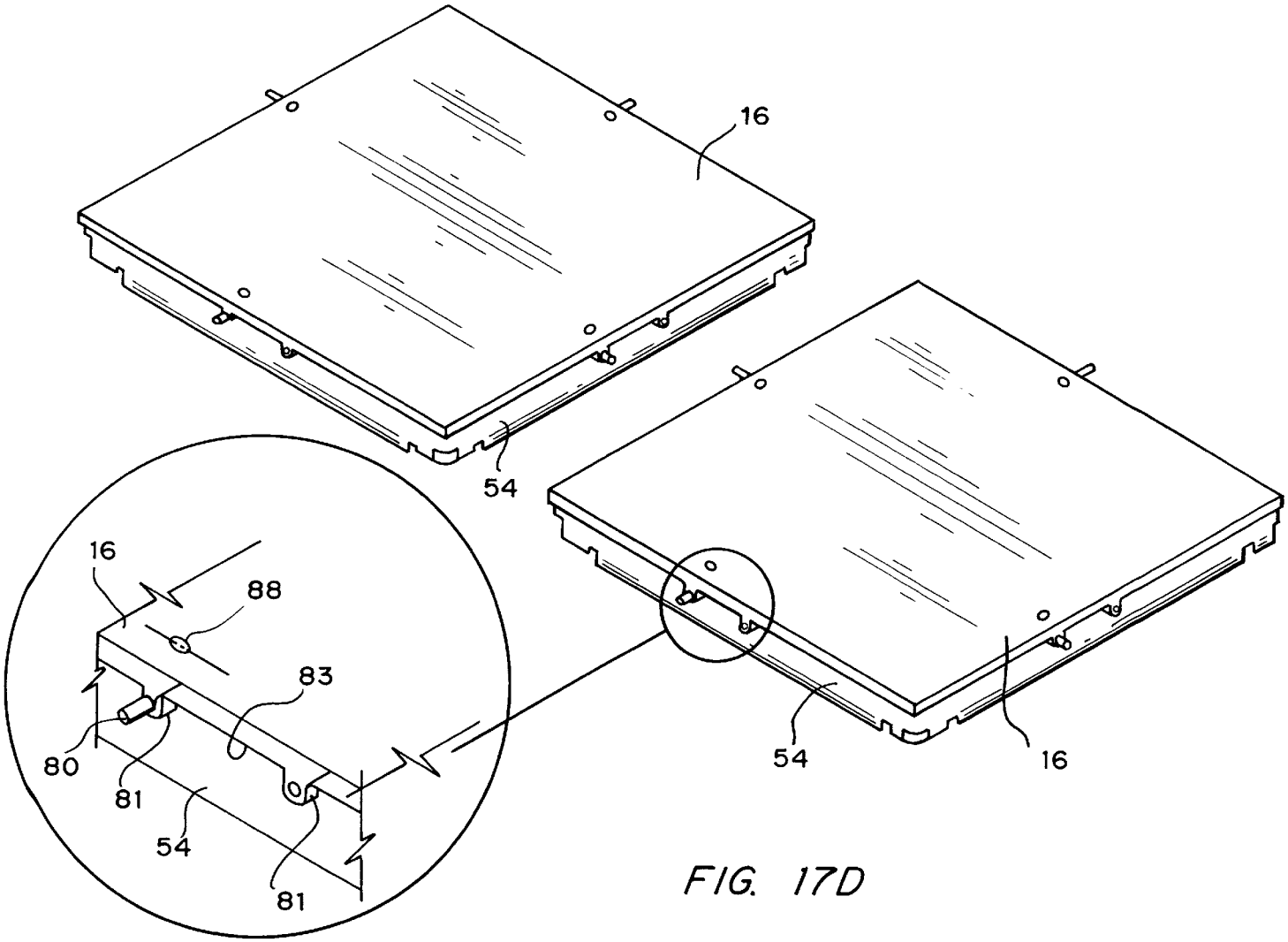
FIG. 17D is a partial cross section of a floor panel of the present invention.

Support bosses 81 may be provided for additional support for support pins 80 and receiver holes 82. As can be seen in FIG. 17D, bosses 81 extend outward from ribs 54 of adjacent panels 10 and surround support pins 80 and receiver holes 82 over the distance between rail 54 and the edge or lip formed by plate 16 as it extends past rib 54. Thus, when support pins 80 are extended into receiver holes 82, there is insufficient space to allow significant deflection of support pin 80. In other words, there is little or no gap at the interface between panels 10 at the point where support pins 82 extensd into receiver holes 82.

As shown in FIGS. 18, 18A–D and FIGS. 19A–D, support structures for flooring panels in accordance with the present invention include features which allow rapid adaptability of the support features to floor panels having different sizes. The following discussion is directed to support structures which have been adapted to be used with floor panels of two sizes, English and Metric panels; however, it should be understood that similar features may be provided to support structures to allow them to accommodate more or less than two floor panel sizes and panel sizes other than English or Metric.

Figure 18B:
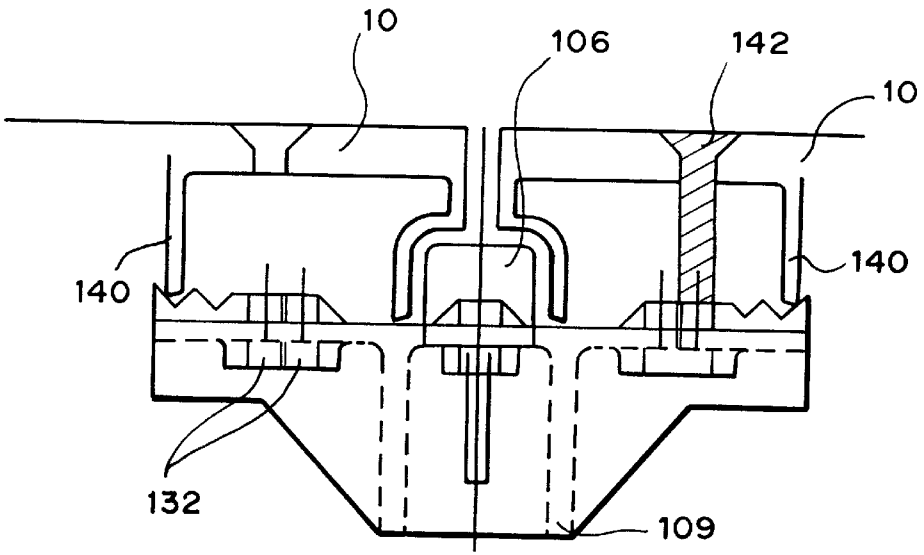
FIG. 18B is a cross-section of the head of FIG. 18 taken along line 18B—18B.
Figure 18E:
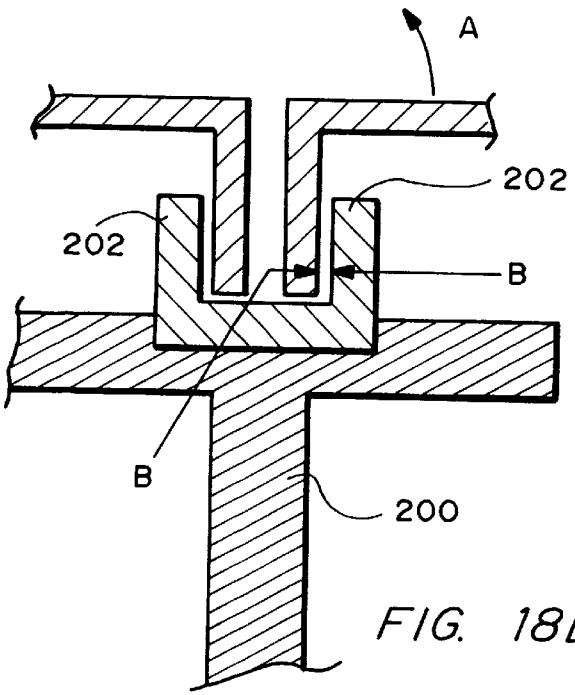
FIG. 18E is a partial side view, in cross-section of a conventional pedestal head showing a panel being lifted off.
Figures 19A, 19B, 19C, 19D:
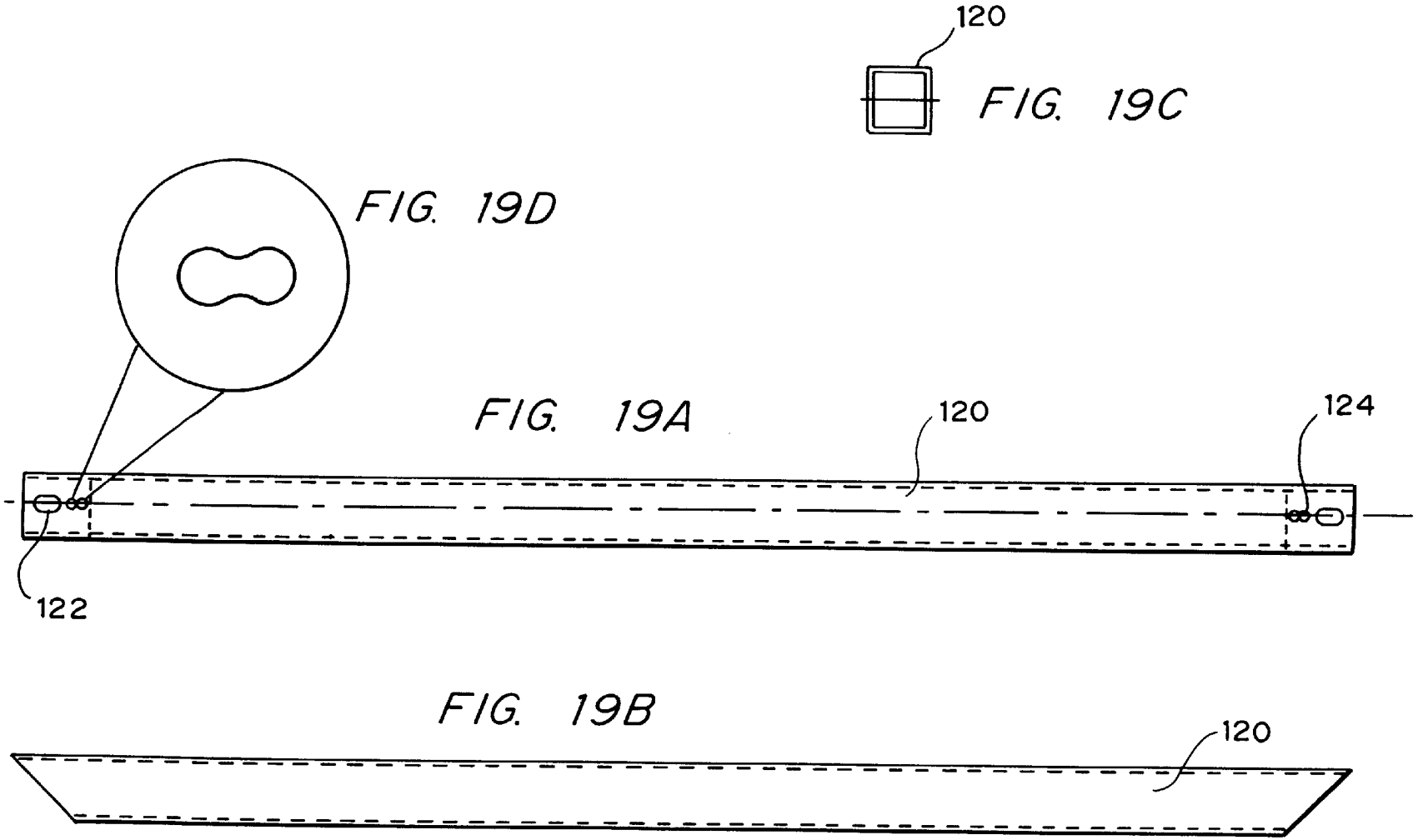
FIG. 19A is a stop view of a pedestal stringer in accordance with the present invention.
FIG. 19B is an end view of the stringer of FIG. 19A.
FIG. 19C is a side view of the stringer of FIG. 19A.
FIG. 19D is a detail of the alignment slot of the stringer of FIG. 19A.

FIG. 18 shows a pedestal head 100 in accordance with the present invention. Pedestal head 100 includes a core 109 and four stringer supports 102 and four panel supports 104 extending therefrom. Pedestal head 100 also includes central alignment boss 106. Stringer supports 102 supports stringers 120 such as those illustrated in FIGS. 19A–D. Stringers 120 interconnect adjacent pedestal heads to ensure the structural rigidity of the underlying support structure. Stringer supports 102 include alignment bosses 108 and fastener attachment points 110. Fastener attachment points 110 may be threaded holes tapped through stringer support 102. These holes correspond to fastener holes 122 of stringers 120. Alignment bosses 108 protrude upward from the surface of stringer support 102 and correspond to variable alignment holes 124 of stringer 120. As can be seen in FIG. 19D variable alignment hole 124 allows pin 108 to be positioned in at least two different places along stringer 102. This allows one stringer 120 to be used when the spacing between pedestal heads may vary to accommodate panels of one size or another. Thus, if as English panel is slightly larger than a Metric panel, the outer end of variable alignment holes 124 of stringer 120 may be aligned with bosses 108. A fastener may then be inserted through hole 122 and threaded into hole 110 thereby fixing stringer 120 to pedestal head 100. Other means of fastening and aligning stringers and pedestal heads may be used as appropriate. For instance, hole 110 need not be threaded but a bolt may be passed through 122 and 110 and a nut affixed to the end of the bolt. Likewise, other forms of alignment pins may be used.

Panel supports 104 include panel alignment slots 130 and panel fastening holds 132. Alignment slots 130 may be angled indentations or any other suitable means of receiving an aligning structure 140 protruding from the base of the panel. Multiple aligning slots 130 may be provided to accommodate for the use of different size panels. In other words, a Metric panel may be slightly smaller than an English panel. Thus, the distance from the edge of the panel to the aligning structure 140 may differ. By providing multiple alignment slots 130 which correspond to the different sizes of panels which may be produced, the same pedestal head 100 may be used for one or the other of the panels selected for use in the particular installation. Screws or other fasteners 142 may be passed through a hole in the panel and directed into fastener holes 132. As with alignment slots 130, multiple fastener holes 132 may be provided to accommodate for the difference in panel sizes that may be available.

Central boss 106 corresponds to indentations in the corner of panels to assist in properly aligning the placement of the panel on the pedestal head. Because the central boss is located at the corners and outside of the panel, it does not interfere with the removal of the panel when such removal is desired. In other words, as illustrated in FIG. 18E, conventional pedestal heads 200 use bosses 202 positioned against inside the edge of the panel. This configuration may cause the edge of the panel, i.e., the web or flange extending down from the surface of the panel, to become wedged between the boss and the adjacent panel. Thus, when a user is removing the panel from the floor to gain access to the subfloor, if the panel is not raised directly upward, but angled up in direction A the force generated by the flange being wedged between the boss and the adjacent panel, as indicated by arrows B, may be considerable. In fact, it is quite common during such removal for conventional panels to act as levers between the pedestal head and panels, generating adequate force to fracture the supporting pedestal head, often requiring replacement. Use of the central boss eliminates this wedging problem and allows the floor panels to be removed either directly upwards or, alternatively, in the angling approach inadvertently used by some installers in lieu of the proper removal method (i.e., directly upwards).

The foregoing is provided for purposes of illustration, explanation, and description of an illustrative embodiments of raised access flooring in accordance with the present invention. Modifications and adaptations to these embodiments will be apparent to those skilled in the art and may be made without departing from the scope or spirit of the invention.

What is claimed is:

1. A raised panel floor structure comprising:

a) at least one plate having peripheral edges and defining a plurality of perforations;

b) a plurality of ribs and cross-members affixed to a bottom surface of the plate and positioned so that the ribs and cross-members do not block the perforations in which at least some of the ribs are positioned at a non-perpendicular angle to at least one of the peripheral edges; and c) a pedestal head comprising a central boss adapted to abut an exterior corner of the panel and at least one panel support having at least two panel alignment slots adapted to receive an aligning structure of the panel.

2. The raised panel floor structure of claim 1 in which the perforations provide an airflow of about 20% to about 55%.

3. The raised panel floor structure of claim 1 in which the perforations are circular.

4. The raised panel floor structure of claim 1 in which the perforations are slots.

5. The raised panel floor structure of claim 4 in which the slots are positioned so that neither major nor minor axes of the slots are perpendicular to an edge of the panel.

6. The raised panel floor structure of claim 1 in which the pedestal head further comprises at least one stringer support having an alignment boss.

7. The raised panel floor structure of claim 6 further comprising at least one stringer having a variable alignment hole affixed to the stringer support such that the alignment boss is received in a portion of the variable alignment hole.

8. The raised panel floor structure of claim 1 further comprising a support pin, a first receiver hole defined in a rib of a first floor panel, and a second receiver hole defined in a rib of a second floor panel adjacent the rib of the first floor panel, wherein the support pin is positioned in the first and second receiver holes.

9. The raised panel floor structure of claim 8 further comprising a vertical shaft positioned in the plate and engaging the support pin.

10. The raised panel floor structure of claim 9 in which the plate further defines an access port positioned adjacent to the support pin.

11. The raised panel floor structure of claim 10 further comprising a removable tool inserted in the access port and engaging the support pin.

12. The raised panel floor structure of claim 11 further comprising a removable anti-vibration pin inserted into the access port.

13. A panel for use with raised panel flooring structures comprising:

a) a plurality of ribs forming a periphery;

b) a plurality of cross-members affixed to the ribs;

c) a plate defining a plurality of perforations and having a bottom surface affixed to the ribs and cross-members, in which the ribs and cross-members are positioned so that the ribs and cross-members do not block the perforations and wherein the ribs protrude a first distance from the bottom surface; and d) a plurality of secondary ribs affixed to the bottom surface and positioned diagonally to the cross-members, the secondary ribs protruding from the bottom surface a second distance, wherein the second distance is about half of the first distance.

14. The panel of claim 13 in which the perforations provide an airflow of about 20% to about 50%.

15. The panel of claim 13 in which the perforations are circular.

16. The panel of claim 13 in which the perforations are slots.

17. The panel of claim 16 in which the slots are positioned so that neither major nor minor axes of the slots are perpendicular to an edge of the panel.

18. The panel of claim 13 in which the secondary ribs are positioned so that the ribs do not block the perforations.

19. The panel of claim 18 in which peripheral edges of the perforations are generally co-terminous with sides of the ribs, cross-members and secondary ribs.

20. A grate for use with raised panel flooring structures comprising:

a) a first, second, third, and fourth rib, wherein the ribs are affixed together to form a square;

b) a first plurality of cross-members positioned in parallel to each other and affixed to the first rib and the second rib, wherein when so affixed at least one cross-member extends directly from the first rib to the second rib;

c) a second plurality of cross-members positioned in parallel to each other and perpendicular to the first plurality of cross-members and affixed to the third nb and the fourth nb; and d) a plurality of ribs, wherein at least one rib is affixed to and positioned diagonally between at least one of the first plurality of cross-members and at least one of the second plurality of cross-members.

21. A universal pedestal head for use with raised panel floor structures comprising:

a) a core;

b) a plurality of panel supports affixed to the core;

c) a plurality of alignment slots affixed to each of the panel supports, wherein the alignment slots are adapted to receive an aligning structure of a panel; and d) a plurality of fastening holes defined in each of the panel supports.

22. The universal pedestal head of claim 21 further comprising a central boss affixed to the core.

23. The universal pedestal head of claim 22 further comprising a plurality of stringer supports affixed to the core.

24. A system for interlocking adjacent panels of a raised panel floor structure comprising:

a) a panel having at least one side rib, each rib defining a pin bore, a shaft bore adjacent to the pin bore and a pin hole;

b) a pin with teeth slidably positioned within the pin bore such that at least some of the teeth are adjacent to the shaft bore; and c) a shaft with teeth rotatably positioned within the shaft bore so that the teeth of the shaft engage the teeth of the pin.

25. The mechanism of claimed 24 further comprising a removable tool with teeth rotatably positioned within the shaft bore so that the teeth of the tool engage the teeth of the pin.

26. The mechanism of claim 24 further comprising an anti-vibration pin with teeth rotatably positioned within the shaft bore so that the teeth of the anti-vibration pin engage the teeth of the pin.

* * * * *

UNITED STATES PATENT AND TRADEMARK OFFICE

CERTIFICATE OF CORRECTION

PATENT NO. : 6,256,952 B1
DATED : July 10, 2001
INVENTOR(S) : Fahy, Jr. et al.

It is certified that error appears in the above-identified patent and that said Letters Patent is hereby corrected as shown below:

Column 12,
Line 3, delete “nb” and insert -- rib --.
Line 4, delete “nb” and insert -- rib --.
Line 35, delete “claimed” and insert -- claim --.

Signed and Sealed this

Fourth Day of March, 2003

JAMES E. ROGAN
*Director of the United States Patent and Trademark Office*